US011779924B2

(12) United States Patent
Xu et al.

(10) Patent No.: US 11,779,924 B2
(45) Date of Patent: Oct. 10, 2023

(54) FLOW STABILIZED CHIP, DROPLET GENERATING SYSTEM AND DROPLET PREPARING METHOD

(71) Applicant: NATIONAL TSING HUA UNIVERSITY, Hsinchu (TW)

(72) Inventors: Jia-Yun Xu, Hsinchu (TW); Jen-Huang Huang, Hsinchu (TW); Chia-Wen Wu, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 158 days.

(21) Appl. No.: 17/351,269

(22) Filed: Jun. 18, 2021

(65) Prior Publication Data

US 2022/0379313 A1 Dec. 1, 2022

(30) Foreign Application Priority Data

May 4, 2021 (TW) ..... 110116071

(51) Int. Cl.
*B01L 3/00* (2006.01)

(52) U.S. Cl.
CPC ..... *B01L 3/502784* (2013.01); *B01L 3/50273* (2013.01); *B01L 2200/06* (2013.01);
(Continued)

(58) Field of Classification Search
CPC .... C09K 19/00; C09K 19/2014; C09K 19/22; C09K 19/24; C09K 19/28; C09K 19/3444;
(Continued)

(56) References Cited

U.S. PATENT DOCUMENTS 10,730,051 B2 8/2020 Davies et al.
2006/0215155 A1* 9/2006 Weber ..... B29C 65/58 356/246

(Continued)

FOREIGN PATENT DOCUMENTS

CN 103097883 A 5/2013
CN 105921066 B 11/2018

(Continued)

OTHER PUBLICATIONS

Zhonghua et a' "A passive flow regulator with low threshold pressure for high-throughput inertial isolation of microbeads" Lab Chip, 15, 3473 (Year: 2015).*

(Continued)

*Primary Examiner* — Jennifer Wecker
*Assistant Examiner* — Jonathan Bortoli
(74) *Attorney, Agent, or Firm* — CKC & Partners Co., LLC

(57) ABSTRACT

A flow stabilized chip includes a chip mainbody, a buffering chamber and two fluid delivery ports. The chip mainbody has a pipe-connection surface. The buffering chamber is disposed in the chip mainbody. The two fluid delivery ports are disposed on the pipe connection surface and connected to the buffering chamber. The chip mainbody includes, in order from the pipe-connection surface to a bottom of the chip mainbody, a first base plate, a first elastic membrane, a second base plate, a second elastic membrane and a third base plate. The first base plate includes a first opening. The second base plate includes a second opening. The third base plate includes a third opening. The first elastic membrane, the second base plate and the second elastic membrane are stacked in sequence to form the buffering chamber.

4 Claims, 20 Drawing Sheets

(52) U.S. Cl.
CPC ..... *B01L 2300/0816* (2013.01); *B01L 2300/0848* (2013.01); *B01L 2300/123* (2013.01); *B01L 2400/0487* (2013.01)

(58) Field of Classification Search
CPC ..... C09K 19/3458; C09K 2019/122; C09K 2019/183; C09K 2019/2042; C09K 2019/3027; C09K 2019/3083; C09K 2219/17; G01N 2021/1704; G01N 2021/8477; G01N 2021/8848; G01N 21/21; G01N 21/77; G01N 21/783; G01N 21/8806; G01N 21/94; G01N 31/223
See application file for complete search history.

(56) References Cited

U.S. PATENT DOCUMENTS

2009/0264550 A1* 10/2009 Rayner ..... B01D 67/0027 521/189
2012/0177543 A1* 7/2012 Battrell ..... F04B 43/043 422/187
2015/0321193 A1* 11/2015 Sprague ..... F16K 99/0015 264/553
2020/0131466 A1* 4/2020 Hsieh ..... C12M 41/48

FOREIGN PATENT DOCUMENTS

TW 201326813 A 7/2013
WO 2019036812 A1 2/2019

OTHER PUBLICATIONS

Yin et al "A Three-Layer Microfluidic Kidney Chip for Drug Nephrotoxicity Test" Int. J. Biosci. Biochem. Bioinform. vol. 9(4): 237-247 ISSN: 2010-3638 (Year: 2019).*
Jia-Yun Xu, "Continuous Production of Monodispersed Water-in-Oil Droplet Using Peristaltic Pumps Integrated with Microfluidic-Based Flow Stabilizer", Graduation Thesis Oral Defense for master's degree of Department of Chemical Engineering, National Tsing Hua University, dated on Jun. 19, 2020, oral presentation, Taiwan, R.O.C.

* cited by examiner

FLOW STABILIZED CHIP, DROPLET GENERATING SYSTEM AND DROPLET PREPARING METHOD

RELATED APPLICATIONS

This application claims priority to Taiwan Application Serial Number 110116071, filed May 4, 2021, which is herein incorporated by reference.

BACKGROUND

Technical Field

The present disclosure relates to a microfluidic chip and a microfluidic system. More particularly, the present disclosure relates to a flow stabilized chip, a droplet generating system and a droplet preparing method that can effectively stabilize turbulent flows.

Description of Related Art

Along with the development of chemical materials technology, stable fluid supply systems are widely used in the fields of electronic packaging, energy materials, biomedicine, etc. Furthermore, by a method that a fluid is supplied as stable and continuous droplets, it is favorable for conducting the preparation of chemical materials, two-phase extraction of liquids, or cell culture, and has application potentials in related markets.

The conventional manufacturing method of the droplets relies on the syringe pump to drive the fluid so as to continuously prepare droplets with stable size and uniform phase. In the manufacturing process of the aforementioned droplets, the liquid of the syringe pump needs to be constantly replenished. However, the output of the liquid is often interrupted temporarily during the liquid replenishment process, resulting in that the stability of the produced droplets will be affected, and the quality of the produced materials thereof or the success rate of related tests may be less than expected.

Therefore, how to develop a droplet generating system that can effectively reduce the disturbance of the fluid from an external environment and then prepare droplets with stable size and uniform phase stably has become the major aim in the related field of academia and industry.

SUMMARY

According to one aspect of the present disclosure, a flow stabilized chip includes a chip mainbody, a buffering chamber and two fluid delivery ports. The chip mainbody has a pipe-connection surface. The buffering chamber is disposed in the chip mainbody. The two fluid delivery ports are disposed on the pipe connection surface and connected to the buffering chamber. The chip mainbody includes, in order from the pipe-connection surface to a bottom of the chip mainbody, a first base plate, a first elastic membrane, a second base plate, a second elastic membrane and a third base plate. The first base plate includes a first opening. The second base plate includes a second opening. The third base plate includes a third opening. The first elastic membrane, the second base plate and the second elastic membrane are stacked in sequence to form the buffering chamber.

According to another aspect of the present disclosure, a droplet generating system includes a fluid storing device, the flow stabilized chip according to the aforementioned aspect, a droplet generating chip and a fluid driving member. The fluid storing device is for storing a solution, wherein the solution is an aqueous phase solution or an oil phase solution. The droplet generating chip is pipe-connected to the flow stabilized chip and includes a mainbody, at least one fluid inlet, a fluid mixing chamber and a droplet outlet, wherein the at least one fluid inlet and the droplet outlet are disposed on the mainbody, the fluid mixing chamber is connected to the at least one fluid inlet and the droplet outlet, and the at least one fluid inlet is connected to one of the fluid delivery ports of the flow stabilized chip. The fluid driving member is pipe-connected to the fluid storing device and the flow stabilized chip, wherein the fluid driving member is for transporting the solution from the fluid storing device to the droplet generating chip through the flow stabilized chip.

According to further another aspect of the present disclosure, a droplet preparing method includes following steps. The droplet generating system according to the aforementioned aspect is provided. A fluid buffering step is performed, wherein the fluid driving member is turned on so as to transport the solution to the buffering chamber of the flow stabilized chip, and then the first elastic membrane and the second elastic membrane of the flow stabilized chip expand and recover interactively along with an operation of the fluid driving member so as to change a volume of the buffering chamber, wherein a flow rate of the solution transported into the flow stabilized chip is 5 μL/min to 5 mL/min. A droplet generating step is performed, wherein the solution is transported to the fluid mixing chamber of the droplet generating chip through the fluid inlet, and then the solution is further transported to a target droplet storing unit through the droplet outlet so as to obtain a plurality of target droplets. A flow rate of the solution in the droplet generating chip is 5 μL/min to 80 μL/min, and an average diameter of the target droplets ranges from 300 μm to 500 μm.

According to still another aspect of the present disclosure, a droplet preparing method includes following steps. The droplet generating system according to the aforementioned aspect is provided. A fluid buffering step is performed, wherein the two fluid driving members are turned on so as to respectively transport the aqueous phase solution and the oil phase solution to the two buffering chambers of the two flow stabilized chips, and then the first elastic membrane and the second elastic membrane of each of the flow stabilized chips expand and recover interactively along with an operation of each of the fluid driving members so as to change a volume of each of the buffering chambers, wherein a flow rate of the aqueous phase solution transported into one of the flow stabilized chips is 5 μL/min to 5 mL/min, and a flow rate of the oil phase solution transported into the other of the flow stabilized chips is 5 μL/min to 5 mL/min. A droplet generating step is performed, wherein the aqueous phase solution and the oil phase solution are respectively transported to the slow-flowing chamber and the fluid mixing chamber of the droplet generating chip through the two fluid inlets, and then the aqueous phase solution and the oil phase solution are mixed in the fluid mixing chamber so as to obtain a plurality of target droplets. The target droplets are oil-in-water droplets or water-in-oil droplets, a flow rate of at least one of the aqueous phase solution and the oil phase solution in the droplet generating chip is 5 μL/min to 80 μL/min, and an average diameter of the target droplets ranges from 300 μm to 500 μm.

BRIEF DESCRIPTION OF THE DRAWINGS

The present disclosure can be more fully understood by reading the following detailed description of the embodiment, with reference made to the accompanying drawings as follows.

DETAILED DESCRIPTION

The present disclosure will be further exemplified by the following specific embodiments. However, the readers should understand that the present disclosure should not be limited to these practical details thereof, that is, in some embodiments, these practical details are used to describe how to implement the materials and methods of the present disclosure and are not necessary.

[Flow Stabilized Chip of the Present Disclosure]

Figure 1:
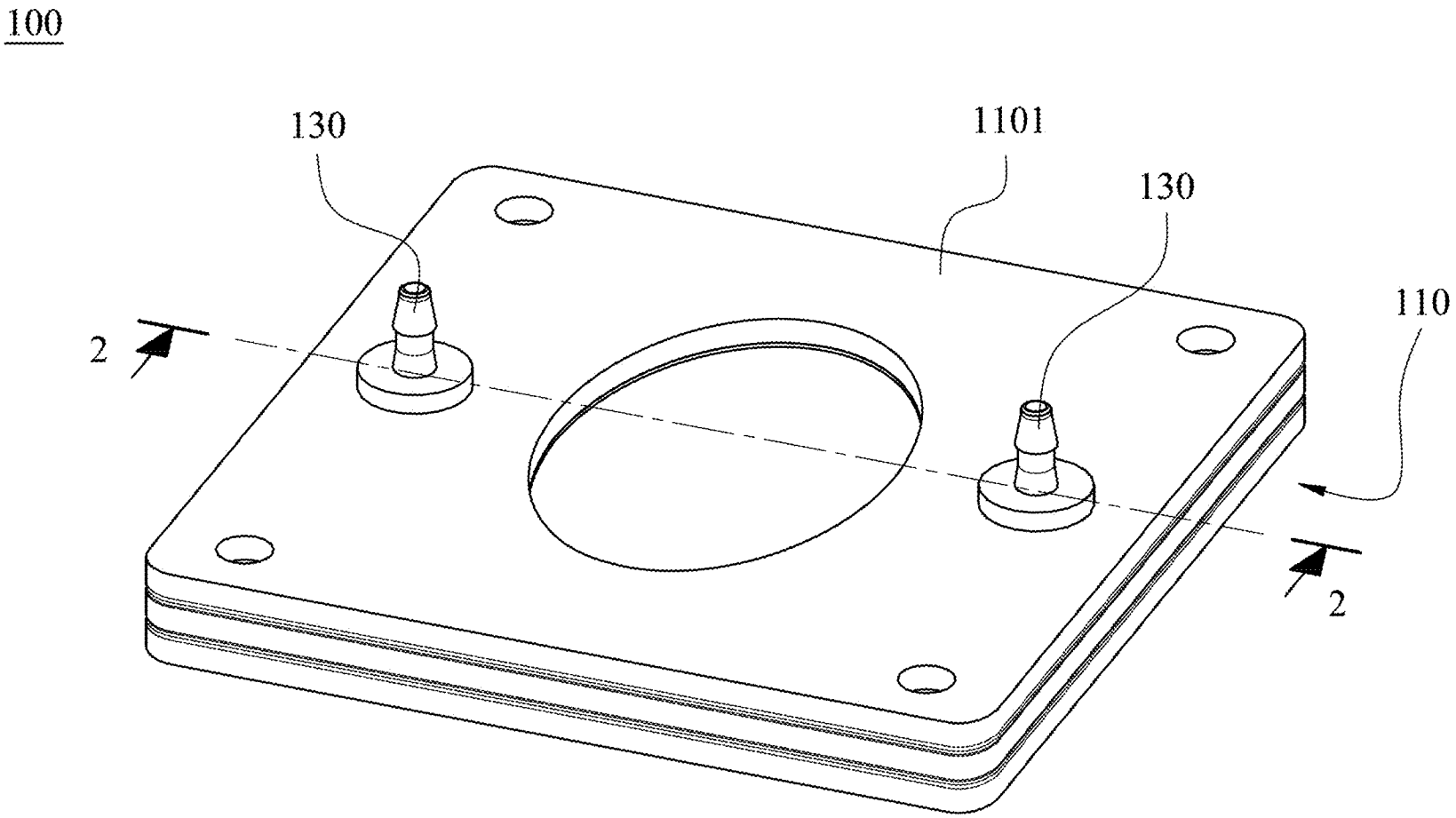
FIG. 1 is a schematic view of a flow stabilized chip according to one embodiment of the present disclosure.
Figure 2:
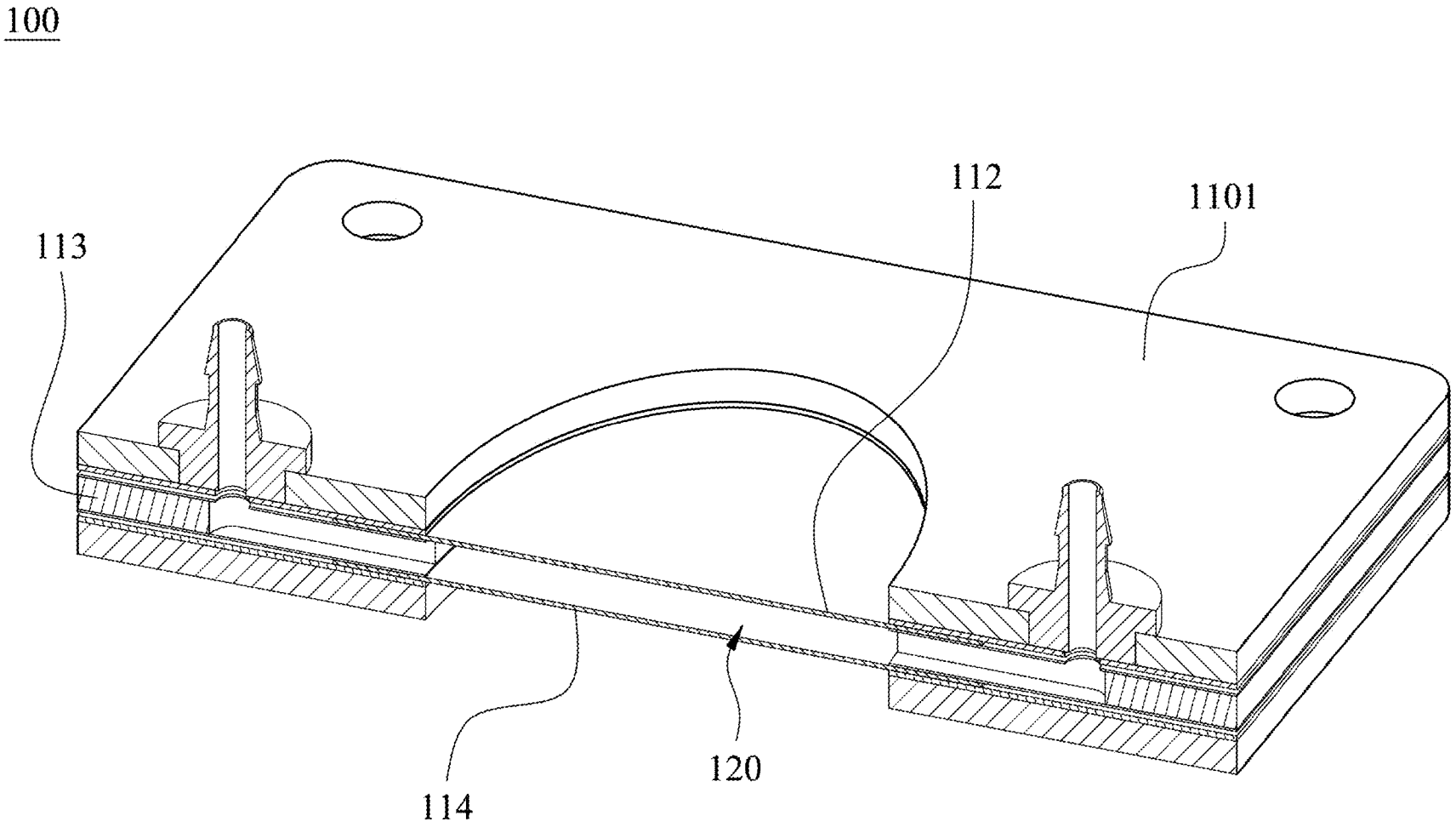
FIG. 2 is a cross-sectional view of the flow stabilized chip of FIG. 1 along Line 2-2.
Figure 3:
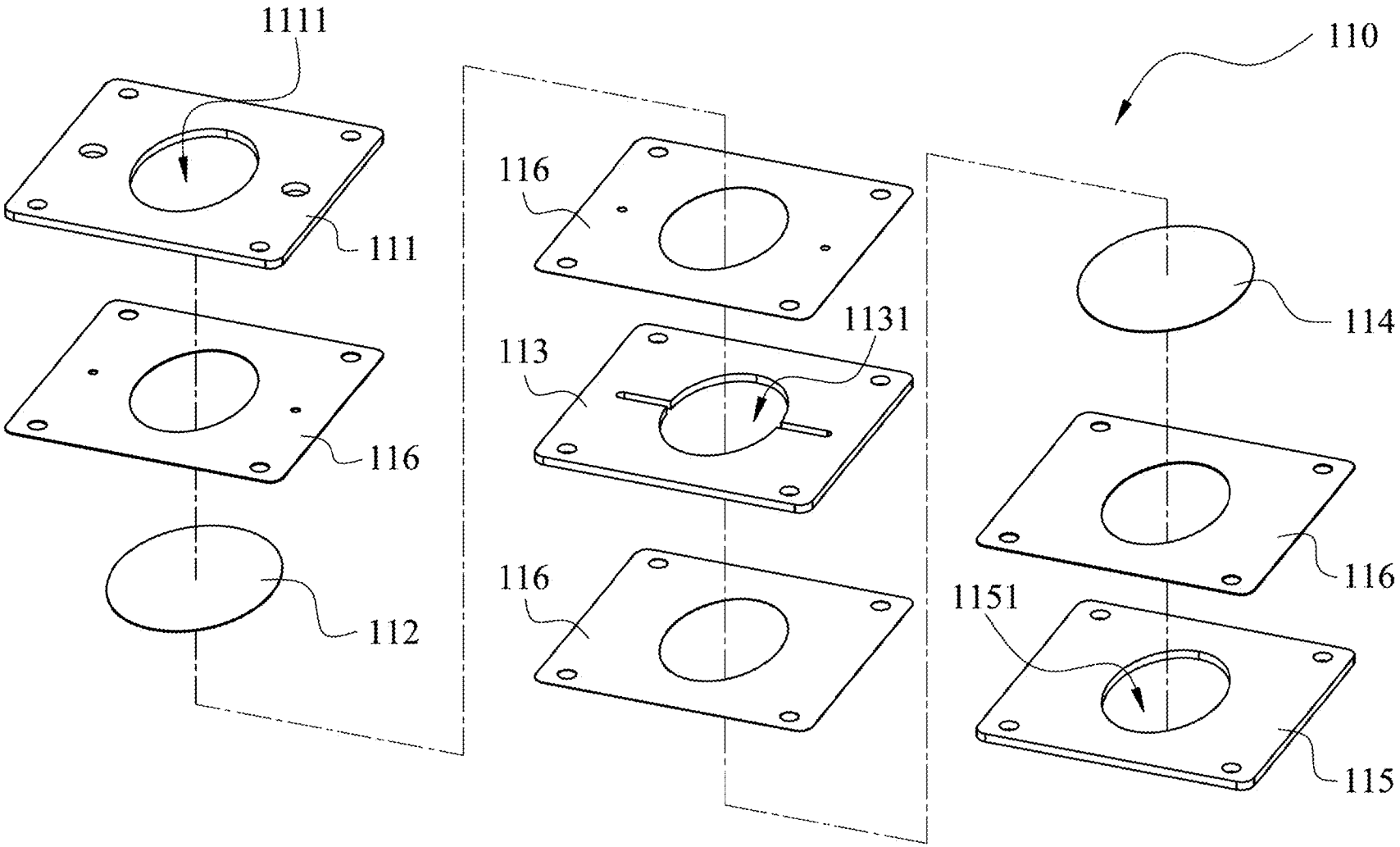
FIG. 3 is an exploded view of a chip mainbody of the flow stabilized chip of FIG. 1.

Please refer to FIG. 1, FIG. 2 and FIG. 3, wherein FIG. 1 is a schematic view of a flow stabilized chip 100 according to one embodiment of the present disclosure, FIG. 2 is a cross-sectional view of the flow stabilized chip 100 of FIG. 1 along Line 2-2, and FIG. 3 is an exploded view of a chip mainbody 110 of the flow stabilized chip 100 of FIG. 1. The flow stabilized chip 100 includes the chip mainbody 110, a buffering chamber 120 and two fluid delivery ports 130.

The chip mainbody 110 has a pipe-connection surface 1101, the buffering chamber 120 is disposed in the chip mainbody 110, the two fluid delivery ports 130 are disposed on the pipe-connection surface 1101, and the two fluid delivery ports 130 are respectively connected to the buffering chamber 120. As shown in FIG. 3, the chip mainbody 110 includes, in order from the pipe-connection surface 1101 to a bottom of the chip mainbody 110, a first base plate 111, a first elastic membrane 112, a second base plate 113, a second elastic membrane 114 and a third base plate 115. The first base plate 111 includes a first opening 1111, the second base plate 113 includes a second opening 1131, and the third base plate 115 includes a third opening 1151. The first elastic membrane 112, the second base plate 113 and the second elastic membrane 114 are stacked in sequence to form the buffering chamber 120.

In detail, when the liquid with a fluctuating flow rate is transported to the buffering chamber 120 of the chip mainbody 110, because the buffering chamber 120 is formed by stacking the first elastic membrane 112, the second base plate 113 and the second elastic membrane 114 in sequence, the first elastic membrane 112 and the second elastic membrane 114 will expand and recover interactively along with a change of flow rate of the liquid at this time. Accordingly, the squeezing pressure caused by the turbulent flow to the buffering chamber 120 will be offset by the reversible deformation of the first elastic membrane 112 and the second elastic membrane 114, so that the fluctuation of the flow rate can be reduced and a liquid with a stable flow rate can be output. Furthermore, when the flow rate of the liquid transported to the buffering chamber 120 suddenly increases, both the first elastic membrane 112 and the second elastic membrane 114 will expand due to the pressure supplied by the liquid so as to store the liquid with an amount more than average thereof. Further, when the flow rate of the liquid transported to the buffering chamber 120 suddenly reduces, the expanding deformation of the first elastic membrane 112 and the second elastic membrane 114 due to the pressure will recover again, so that the liquid stored in the buffering chamber 120 will be discharged through one of the fluid delivery ports 130 so as to keep the balance of the pressure and the flow rate. Moreover, the first elastic membrane 112 and the second elastic membrane 114 can be made of latex or nitrile butadiene rubber (NBR), a minimum diameter of the buffering chamber 120 can range from 1 mm to 300 mm, but the present disclosure is not limited thereto.

Furthermore, in the embodiment of FIG. 3, the chip mainbody 110 can further include four plastic sheets 116, and the four plastic sheets 116 are respectively disposed between the first base plate 111 and the first elastic membrane 112, between the first elastic membrane 112 and the second base plate 113, between the second base plate 113 and the second elastic membrane 114, and between the second elastic membrane 114 and the third base plate 115. Therefore, it is not only favorable for effectively increasing the assembling allowance of the first base plate 111, the first elastic membrane 112, the second base plate 113, the second elastic membrane 114 and the third base plate 115 of the chip mainbody 110, but also the structure of the chip mainbody 110 can be more stable. Thus, the effectivity for stabilizing the flow rate of the liquid can be enhanced. Furthermore, the first base plate 111, the second base plate 113 and the third base plate 115 can be made by a laser cutting method so as to make quickly and accurately. Further, the first base plate 111, the second base plate 113, the third base plate 115 and the four plastic sheets 116 can be made of different resin polymer materials according to actual needs. Thus, it is favorable for enhancing the manufacturing efficiency and facilitating mass production.

Therefore, by the arrangement that the first elastic membrane 112, the second base plate 113 and the second elastic membrane 114 are stacked in sequence to form the buffering chamber 120, the flow stabilized chip 100 of the present disclosure can buffer the liquid automatically when the liquid is transported to the buffering chamber 120 so as to achieve a high stabilized efficiency to the flow rate of the turbulent flows. Thus, the stability of the flows output by the flow stabilized chip 100 of the present disclosure can be enhanced significantly and has application potentials in related markets.

[Droplet Generating System of the Present Disclosure]

Figure 4:
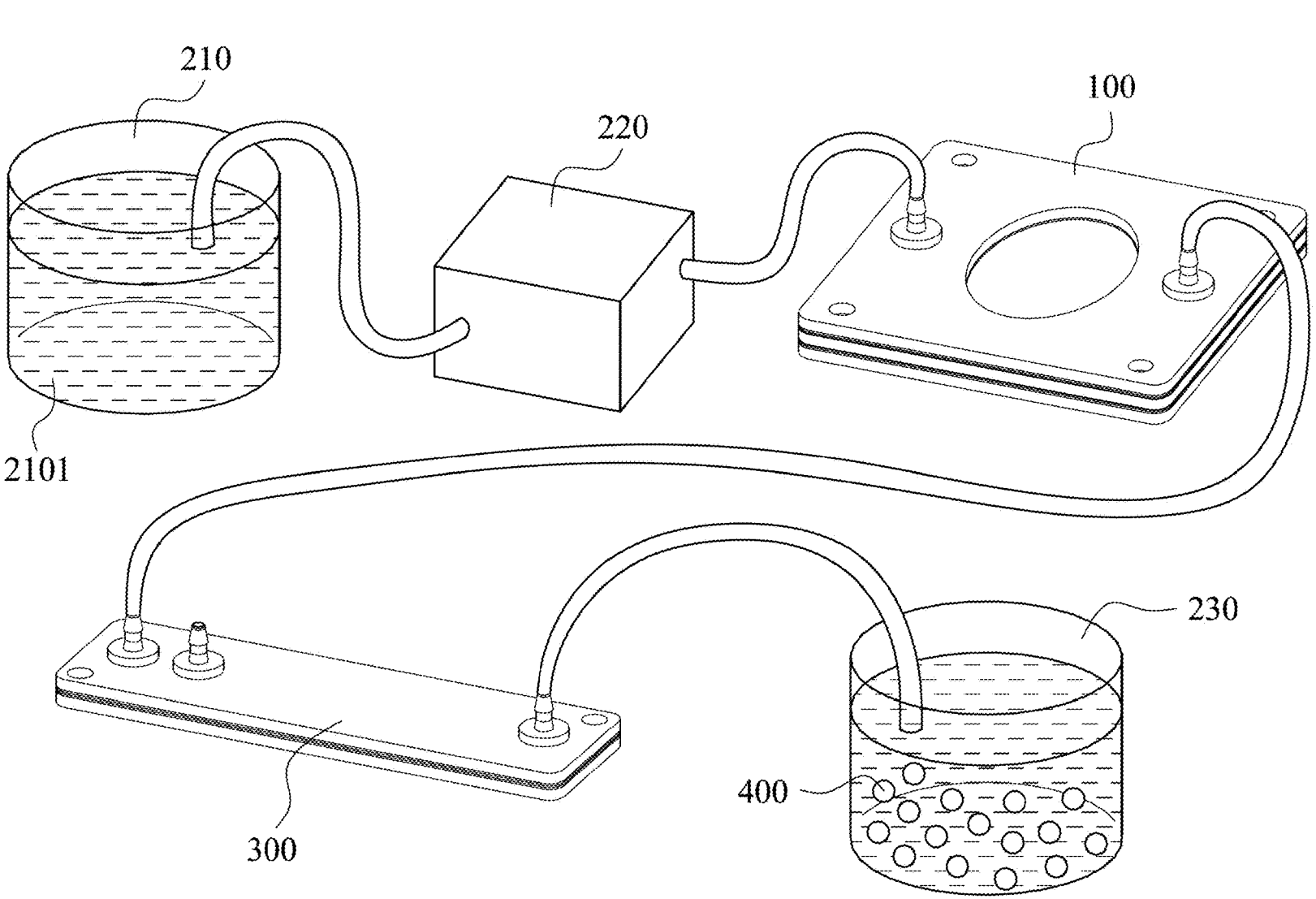
FIG. 4 is a schematic view of a droplet generating system according to another embodiment of the present disclosure.

Please refer to FIG. 4, which is a schematic view of a droplet generating system 200 according to another embodiment of the present disclosure. The droplet generating system 200 includes a fluid storing device 210, the flow stabilized chip 100, a droplet generating chip 300 and a fluid driving member 220.

The fluid storing device 210 is for storing a solution 2101. In detail, the solution 2101 is an initial solution of the droplets in the following formation process and can be an aqueous phase solution or an oil phase solution. Further, the structural details of the flow stabilized chip 100 have been illustrated in the aforementioned description and will not be described again herein.

Figure 5:
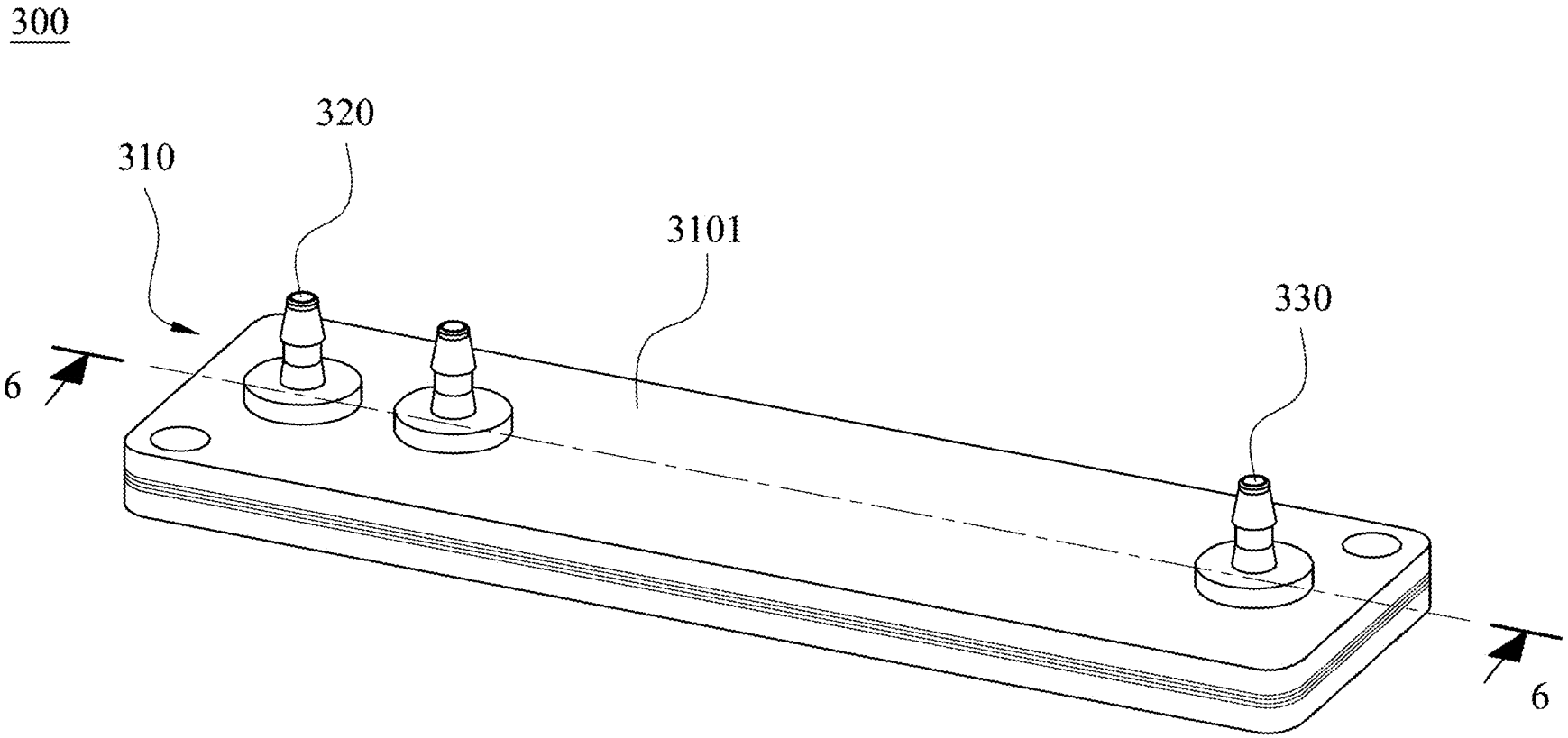
FIG. 5 is a schematic view of a droplet generating chip of the droplet generating system of FIG. 4.
Figure 6:
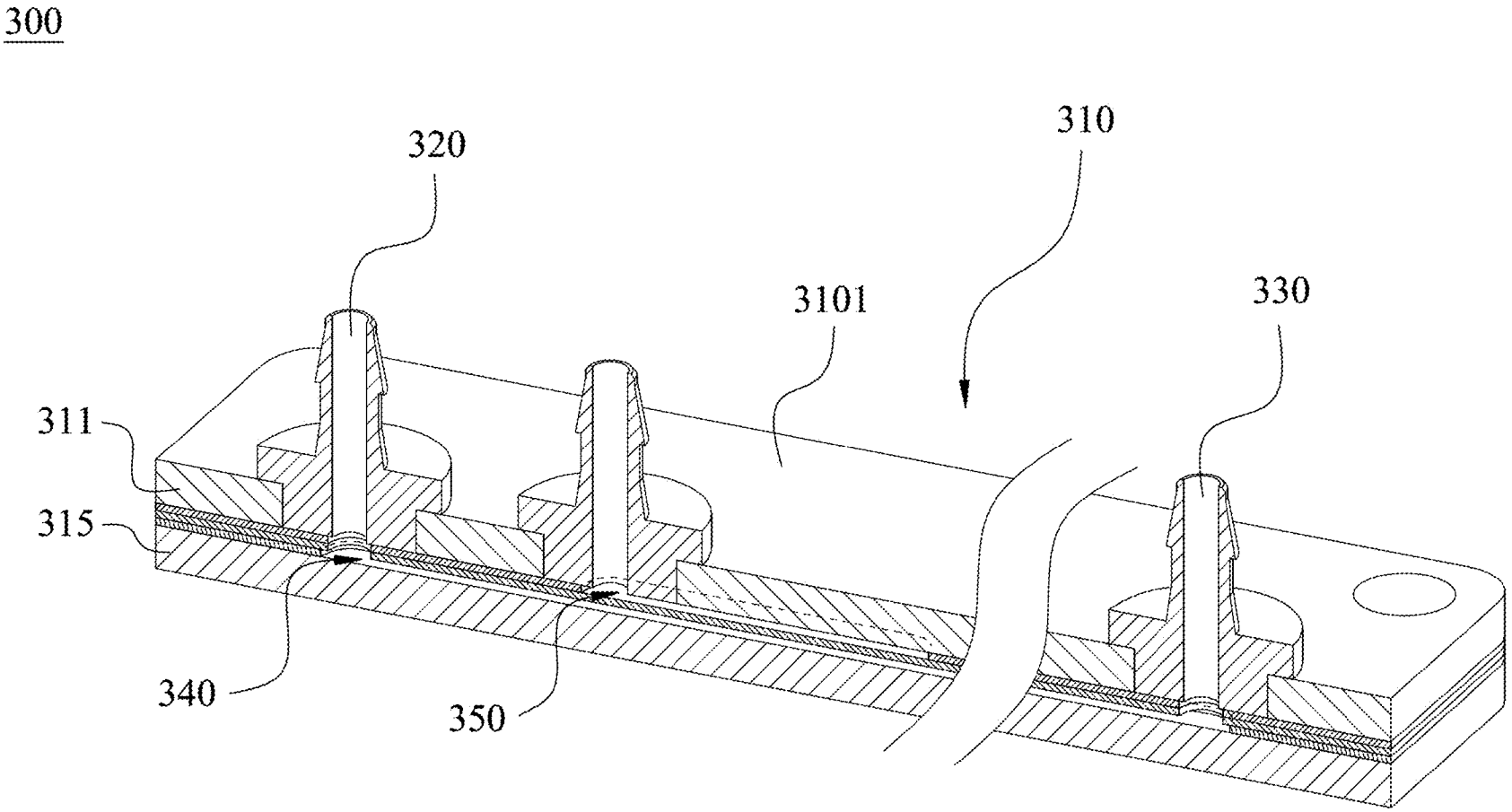
FIG. 6 is a cross-sectional view of the droplet generating chip of FIG. 5 along Line 6-6.

Please refer to FIG. 4, FIG. 5 and FIG. 6 simultaneously, wherein FIG. 5 is a schematic view of a droplet generating chip 300 of the droplet generating system 200 of FIG. 4, and FIG. 6 is a cross-sectional view of the droplet generating chip 300 of FIG. 5 along Line 6-6. As shown in FIG. 4, FIG. 5 and FIG. 6, the droplet generating chip 300 is pipe-connected to the flow stabilized chip 100, wherein the droplet generating chip 300 includes a mainbody 310, at least one fluid inlet 320, a fluid mixing chamber 340 and a droplet outlet 330. The at least one fluid inlet 320 and the droplet outlet 330 are disposed on the mainbody 310, the fluid mixing chamber 340 is connected to the at least one fluid inlet 320 and a droplet outlet 330, and the at least one fluid inlet 320 is connected to one of the fluid delivery ports 130 of the flow stabilized chip 100. Furthermore, as shown in FIG. 4, the droplet generating system 200 can further include a target droplet storing unit 230. The target droplet storing unit 230 is for storing target droplets 400 so as to supply the needs of the following experiments. Accordingly, the use of the droplet generating system 200 of the present disclosure is more convenient.

Figure 7:
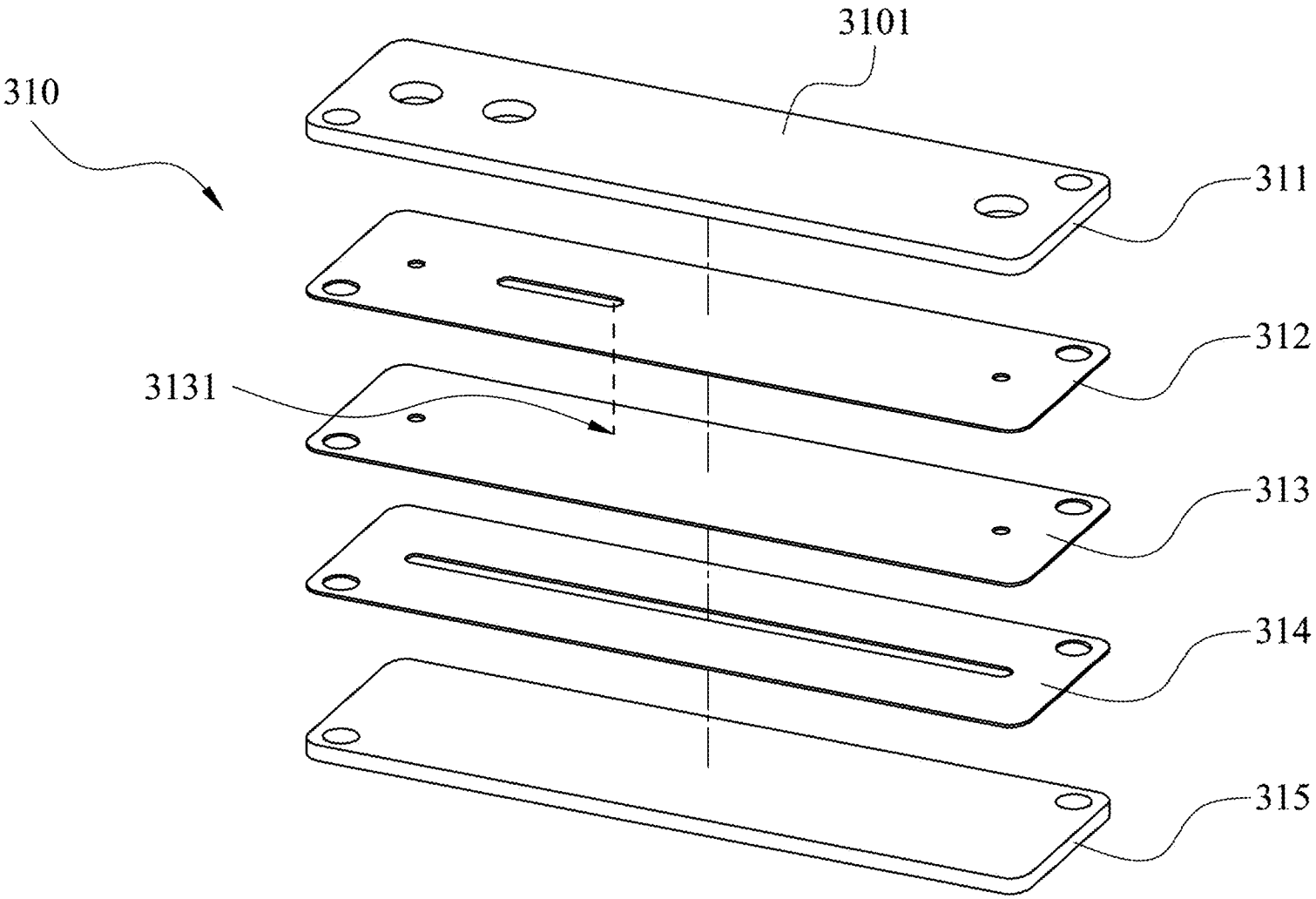
FIG. 7 is an exploded view of the droplet generating chip of FIG. 5.

Please refer to FIG. 5, FIG. 6 and FIG. 7 simultaneously, wherein FIG. 7 is an exploded view of the droplet generating chip 300 of FIG. 5. As shown in FIG. 7, the mainbody 310 of the droplet generating chip 300 has a chip surface 3101, and the mainbody 310 includes, in order from the chip surface 3101 to a bottom of the mainbody 310, a first channel substrate 311, a first plastic plate 312, a second plastic plate 313, a third plastic plate 314 and a second channel substrate 315, wherein the second plastic plate 313, the third plastic plate 314 and the second channel substrate 315 are stacked in sequence to form the fluid mixing chamber 340. Therefore, the assembling allowance of the droplet generating chip 300 can be effectively increased, and the overall structure thereof can be more stable. Furthermore, the first channel substrate 311, the first plastic plate 312, the second plastic plate 313, the third plastic plate 314 and the second channel substrate 315 can be made by a laser cutting method so as to make quickly and accurately. Further, the first channel substrate 311, the first plastic plate 312, the second plastic plate 313, the third plastic plate 314 and the second channel substrate 315 can be made of different resin polymer materials according to actual needs. Thus, it is favorable for enhancing the manufacturing efficiency and facilitating mass production.

The fluid driving member 220 is pipe-connected to the fluid storing device 210 and the flow stabilized chip 100, and the fluid driving member 220 is for transporting the solution 2101 from the fluid storing device 210 to the droplet generating chip 300 through the flow stabilized chip 100. Furthermore, the fluid driving member 220 can be a peristaltic pump. The peristaltic pump can transport the liquid by pressing and releasing the peristaltic tubes (not shown) thereof by turns, so that the liquid therein can be isolated within the peristaltic tubes without contact with other elements of the peristaltic pump. Therefore, due to the peristaltic pump has the advantage of a low contaminate rate and can be used to transport the liquid continuously, the droplet generating system 200 of the present disclosure can be used to prepare the droplets under the premise that the flow path is without the blocking by air bubbles. Moreover, by the arrangement that the peristaltic pump is used as the fluid driving member 220 of the droplet generating system 200 of the present disclosure instead of the syringe pump which is applied in the conventional preparing method of the droplets, it is favorable for establishing the circulation channel of the fluid according to actual needs, and the aqueous phase solution or the oil phase solution continuously flowed in the droplet generating system 200 can be reused so as to reduce waste and cost less.

Figure 8:
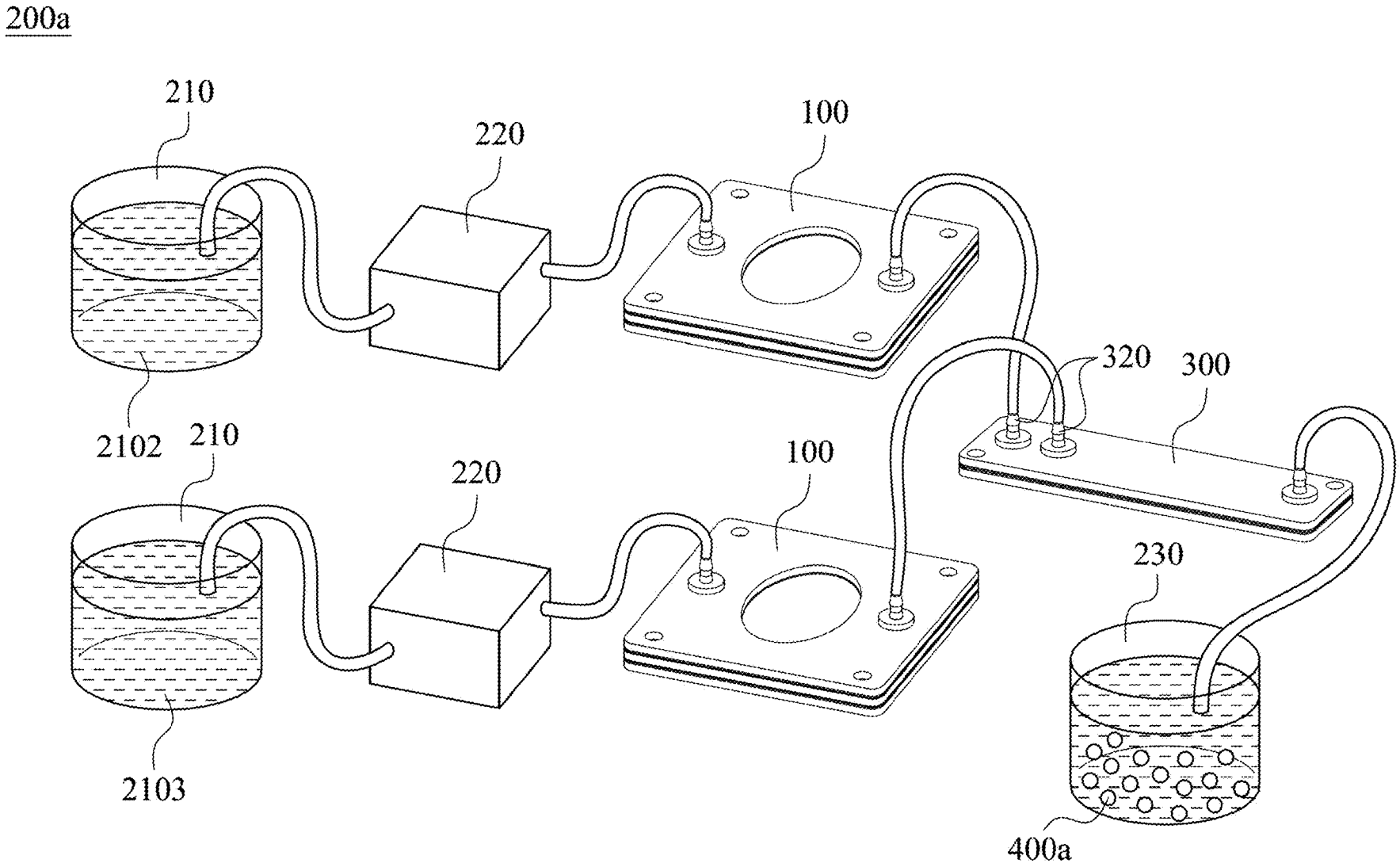
FIG. 8 is a schematic view of a droplet generating system according to further another embodiment of the present disclosure.

Please refer to FIG. 6, FIG. 7 and FIG. 8 simultaneously, wherein FIG. 8 is a schematic view of a droplet generating system **200*a* according to further another embodiment of the present disclosure. The droplet generating system 200***a* and the droplet generating system 200 of FIG. 4 are similar with each other in the arrangement of elements and the structures thereof, so that the details of the same element are not described herein.

As shown in FIG. 6, FIG. 7 and FIG. 8, the droplet generating system 200*a* of FIG. 8 includes two fluid storing devices 210, two flow stabilized chips 100, one droplet generating chip 300, two fluid driving members 220 and one target droplet storing unit 230, wherein the droplet generating chip 300 includes two fluid inlets 320. Each of the fluid driving members 220 is pipe-connected to one of the fluid storing devices 210 and one of the flow stabilized chips 100, and the two fluid storing devices 210 respectively store a first solution 2102 and a second solution 2103. The first solution 2102 can be the aqueous phase solution or the oil phase solution according to actual needs, and the second solution 2103 also can be the aqueous phase solution or the oil phase solution according to actual needs.

The two flow stabilized chips 100 are respectively pipe-connected to the two fluid inlets 320 of the droplet generating chip 300. The first channel substrate 311, the first plastic plate 312 and the second plastic plate 313 are stacked in sequence to form a slow-flowing chamber 350 (marked in FIG. 6), the second plastic plate 313 includes a nanohole 3131, and the slow-flowing chamber 350 and the fluid mixing chamber 340 are connected to each other through the nanohole 3131.

The target droplet storing unit 230 is pipe-connected to the droplet outlet 330 and is for storing target droplets 400*a*, and the target droplet storing unit 230 can be pipe-connected to one of the fluid storing devices 210 according to actual needs. The target droplet storing unit 230 can include a buffer solution (reference number is omitted), and the buffer solution can include the first solution 2102 or the second solution 2103. In detail, when the target droplet storing unit 230 is pipe-connected to one of the fluid storing devices 210, the first solution 2102 or the second solution 2103 of the buffer solution can be transported to the fluid storing device 210 which is pipe-connected to the target droplet storing unit 230 due to the driving of the fluid driving member 220. Accordingly, not only a continuously-flow fluid system can be formed, but also the first solution 2102 or the second solution 2103 can be recycled and reused again. Thus, the costs and the waste of consumables can be reduced, and an aim of continuous production of target droplets 400*a* for more than 24 hours can be achieved.

In particular, in the embodiment of FIG. 8, the droplet generating system 200*a* is for preparing oil-in-water droplets or water-in-oil droplets. For example, when the first solution 2102 is an aqueous phase solution and the second solution 2103 is an oil phase solution, the first solution 2102 can be transported to the fluid mixing chamber 340 through one of the flow stabilized chips 100, and the second solution 2103 can be transported to the slow-flowing chamber 350 through the other of the flow stabilized chips 100. At this time, because the slow-flowing chamber 350 and the fluid mixing chamber 340 are connected to each other through the nanohole 3131, the second solution 2103 stored in the slow-flowing chamber 350 which is disposed above the fluid mixing chamber 340 will be stably dripped into the first solution 2102 through the nanohole 3131 due to the driving of the fluid driving member 220 and the action of gravity so as to prepare target droplets 400*a* in an oil-in-water pattern with stable size and uniform phase. Further, the target droplets 400*a* will be transported into the target droplet storing unit 230 through the droplet outlet 330 of the droplet generating chip 300 so as to provide the needs of the following applications.

Furthermore, although it is not shown in the drawings, in the droplet generating system 200*a* of the present disclosure, the two flow stabilized chips 100 can be respectively connected to the droplet generating chip 300 of by two communicating tubes (reference numbers are omitted), wherein each of the communicating tubes can include a compressed tubule (not shown), and a diameter of each of the compressed tubules can range from 0.25 mm to 1.00 mm. In detail, by the arrangement that the compressed tubule is disposed between the flow stabilized chip 100 and the droplet generating chip 300, an extra pressure can be applied to the fluid output from the fluid delivery port 130 of the flow stabilized chip 100, so that the fluctuation of the flow rate can be further reduced. Furthermore, each of the compressed tubules can be made of poly-ether-ether-ketone (PEEK), but the present disclosure is not limited thereto.

Therefore, by the connection of the flow stabilized chip 100, the droplet generating chip 300 and the fluid driving member 220 of the droplet generating system 200 and the droplet generating system 200*a* of the present disclosure, the fluctuation of the flow rate of the fluid will be stabilized first while passing through the flow stabilized chip 100, and the droplets with stable size can be prepared continuously by the droplet generating chip 300. Thus, it has application potentials in related markets. Furthermore, the droplet generating system 200 and the droplet generating system 200*a* of the present disclosure not only can be used to continuously and stably prepare water-phase droplets and oil-phase droplets with stable size for a long time, but also can be further used to prepare oil-in-water droplets or water-in-oil droplets. Thus, it is favorable for conducting the preparation of chemical materials, two-phase extraction of liquids, or cell culture, and has application potentials in related markets.

[Droplet Preparing Method of the Present Disclosure]

I. Preparing Water-Phase Droplets or Oil-Phase Droplets

Figure 9:
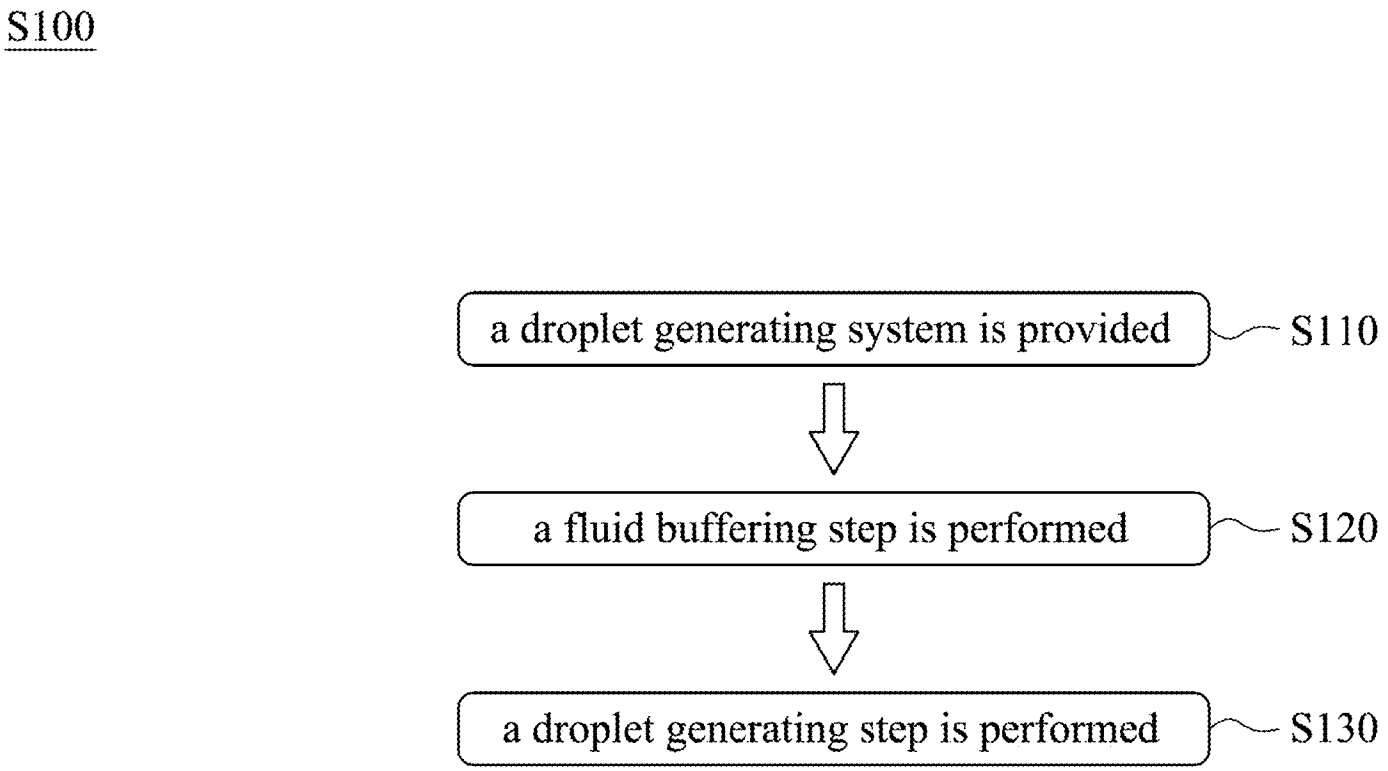
FIG. 9 is a flow chart of a droplet preparing method according to still another embodiment of the present disclosure.

Please refer to FIG. 9, which is a flow chart of a droplet preparing method S100 according to still another embodiment of the present disclosure. In detail, the droplet preparing method S100 is used to prepare water-phase droplets or oil-phase droplets with stable size, and the droplet preparing method S100 includes Step S110, Step S120 and Step S130.

In Step S110, a droplet generating system is provided. In detail, the aforementioned droplet generating system can be the droplet generating system 200 of FIG. 4, so that the arrangement of the elements of the droplet generating system 200 and the details thereof are not described herein. The operating details of the droplet preparing method S100 of the present disclosure will be illustrated by the assistance of the droplet generating system 200.

In Step S120, a fluid buffering step is performed, wherein the fluid driving member 220 is turned on so as to transport the solution 2101 of the fluid storing device 210 to the buffering chamber 120 of the flow stabilized chip 100. The solution 2101 can be selected as the aqueous phase solution or the oil phase solution according to actual needs. In the same time, the first elastic membrane 112 and the second elastic membrane 114 of the flow stabilized chip 100 will expand and recover interactively along with an operation of the fluid driving member 220 so as to change a volume of the buffering chamber 120, and a flow rate of the solution 2101 transported into the flow stabilized chip 100 is 5 μL/min to 5 mL/min.

In Step S130, a droplet generating step is performed, wherein the solution 2101 is transported to the fluid mixing chamber 340 of the droplet generating chip 300 through the fluid inlet 320, and then the solution 2101 is further transported to the target droplet storing unit 230 through the droplet outlet 330 so as to obtain a plurality of target droplets 400. Wherein, the target droplets 400 are water-phase droplets or oil-phase droplets with stable sizes, an average diameter of the target droplets 400 ranges from 300 μm to 500 μm, and a flow rate of the solution 2101 in the droplet generating chip 300 ranges from 5 μL/min to 80 μL/min.

II. Preparing Oil-In-Water Droplets or Water-In-Oil Droplets

Figure 10:
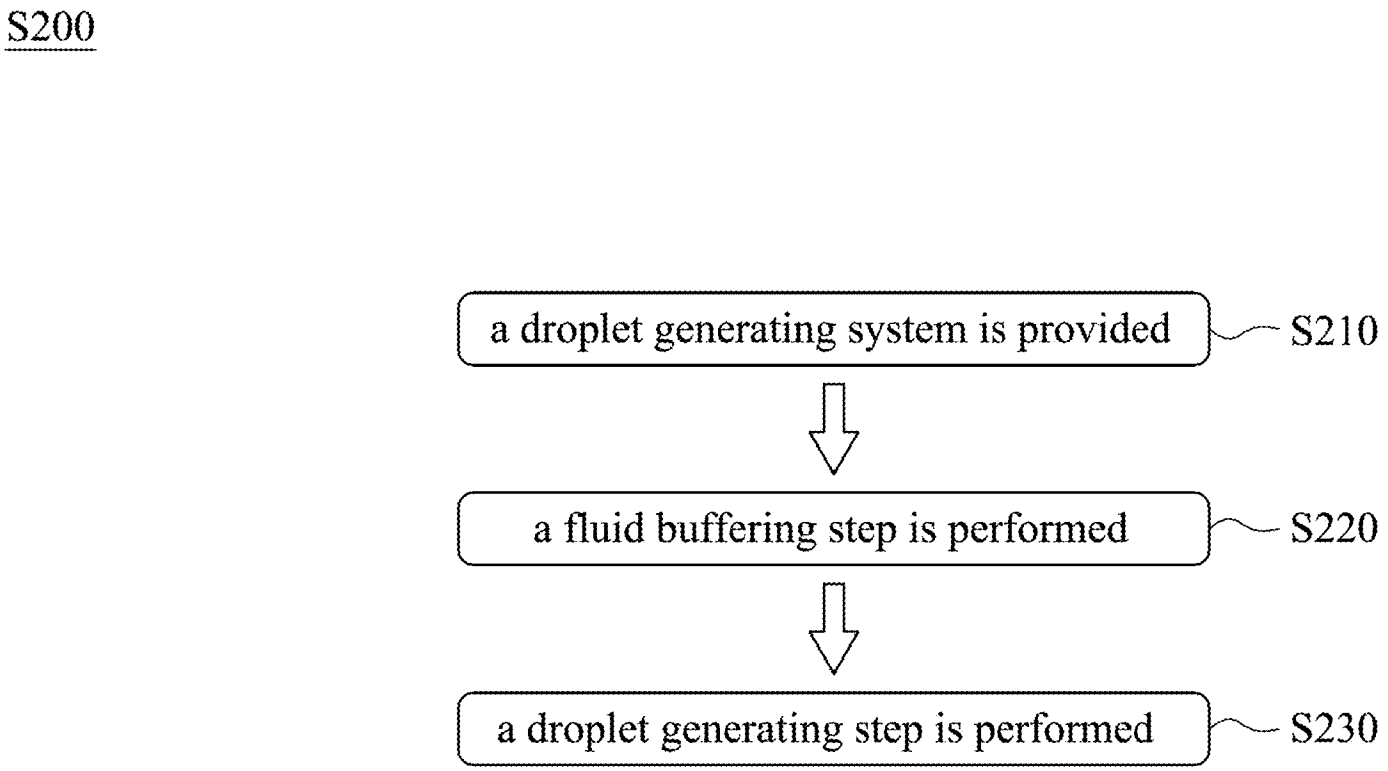
FIG. 10 is a flow chart of a droplet preparing method according to yet another embodiment of the present disclosure.

Please refer to FIG. 10, which is a flow chart of a droplet preparing method S200 according to yet another embodiment of the present disclosure. In detail, the droplet preparing method S200 is used to prepare oil-in-water droplets or water-in-oil droplets with stable size and uniform phase, and the droplet preparing method S200 includes Step S210, Step S220 and Step S230.

In Step S210, a droplet generating system is provided. In detail, the aforementioned droplet generating system can be the droplet generating system 200*a* of FIG. 8, so that the arrangement of the elements of the droplet generating system 200*a* and the details thereof are not described herein. The operating details of the droplet preparing method S200 of the present disclosure will be illustrated by the assistance of the droplet generating system 200*a*. The two fluid storing devices 210 of the droplet generating system 200*a* respectively store the first solution 2102 and the second solution 2103. In the embodiment of FIG. 10, the first solution 2102 is the oil phase solution and the second solution 2103 is the aqueous phase solution so as to illustrate the preparing method of the target droplets 400*a* in a water-in-oil pattern. However, the solution types of the first solution 2102 and the second solution 2103 can be adjusted according to actual needs, and the present disclosure is not limited thereto.

In Step S220, a fluid buffering step is performed, wherein the two fluid driving members 220 are turned on so as to respectively transport the first solution 2102 and the second solution 2103 of the two fluid storing devices 210 to the two buffering chambers 120 of the two flow stabilized chips. At this time, the first elastic membrane 112 and the second elastic membrane 114 of each of the flow stabilized chips 100 will expand and recover interactively along with an operation of each of the fluid driving members 220 so as to change a volume of each of the buffering chamber 120, wherein a flow rate of the first solution 2102 transported into one of the flow stabilized chips 100 is 5 μL/min to 5 mL/min, and a flow rate of the second solution 2103 transported into the other of the flow stabilized chips 100 is 5 μL/min to 5 mL/min.

In Step S230, a droplet generating step is performed, wherein the first solution 2102 and the second solution 2103 are respectively transported to the fluid mixing chamber 340 and the slow-flowing chamber 350 of the droplet generating chip 300 through the two fluid inlet 320, and then the first solution 2102 and the second solution 2103 are mixed in the fluid mixing chamber 340 so as to obtain a plurality of target droplets 400*a*. A flow rate of the second solution 2103, that is, the major material of the target droplets 400*a* in the droplet preparing method S200, in the droplet generating chip 300 is 5 μL/min to 80 μL/min.

In detail, because the slow-flowing chamber 350 and the fluid mixing chamber 340 are connected to each other through the nanohole 3131 and the slow-flowing chamber 350 is disposed above the fluid mixing chamber 340, the second solution 2103 being the aqueous phase solution will be stably dripped into the first solution 2102 being the oil phase solution through the nanohole 3131 due to the driving of the fluid driving members 220 and the action of gravity so as to prepare droplets 400*a* in the water-in-oil pattern with stable size and uniform phase. Further, an average diameter of the target droplets 400*a* ranges from 300 μm to 500 μm.

Therefore, by the arrangements of the flow stabilized chip 100, the droplet generating chip 300 and the fluid driving member 220 of the droplet generating system 200 or the droplet generating system 200*a*, the fluctuation of the flow rate of the fluid can be stabilized in the fluid buffering step, and then the liquid will be transported through the fluid mixing chamber 340 or the slow-flowing chamber 350 in the droplet generating step so as to continuously prepare droplets with stable size and uniform phase. Thus, the droplet preparing method S100 and the droplet preparing method S200 of the present disclosure have application potentials in related markets.

EXAMPLES AND COMPARATIVE EXAMPLE

The droplet preparing method of the present disclosure will be applied to prepare the target droplets along with the droplet generating system so as to further illustrate the characteristics of the target droplets prepared under different settings of parameters of the droplet generating system and the droplet preparing method of the present disclosure. However, the readers should understand that the present disclosure should not be limited to these practical details thereof, that is, in some embodiments, these practical details are used to describe how to implement the materials and methods of the present disclosure and are not necessary.

In the following examples, the aqueous phase solution is pure water, and the oil phase solution of the present disclosure is prepared by adding soybean oil with a mass concentration being 5% w/v into polyglyceryl-10 polyricinoleate (PGPR) for the following experiments. Furthermore, in the following examples, a thickness of the first elastic membrane is the same as a thickness of the second elastic membrane in the flow stabilized chip, and the first elastic membrane and the second elastic membrane are made of the same material so as to facilitate following analysis.

I. Effects of the Minimum Diameter of the Buffering Chambers to the Fluctuation of the Flow Rate of the Fluid In the present experiment, the reduction of the fluctuation of the flow rate of the fluid driven by the peristaltic pump is analyzed under the conditions that the flow stabilized chip of the droplet generating system of the present disclosure includes buffering chambers with different minimum diameters. In the test, the pure water with a flow rate being 5 μL/min to 5 mL/min is served as the aqueous phase solution, and the buffering chamber is formed by the stacked arrangement of the first elastic membrane and the second elastic membrane made of latex and the second base plate. Furthermore, in the present experiment, it is also compared with the fluctuation of the flow rate of the pure water driven by a peristaltic pump alone, and the fluctuation reduced rate (FR) of the fluid which is processed after by the droplet generating system of the present disclosure will be further calculated based on the fluctuation reduced rate formula (I). The fluctuation reduced rate formula (I) is shown as follows.

$$\text{Fluctuation reduced rate (\%)} = \left(1 - \frac{l_i}{l_0}\right) \times 100\%. \qquad \text{Formula (I)}$$

Wherein, $l_i$ represents the maximum flow rate amplitude of the fluid processed after by the droplet generating system of the present disclosure, and $l_o$ represents the maximum flow rate amplitude of the fluid without the process by the droplet generating system of the present disclosure.

Figure 11:
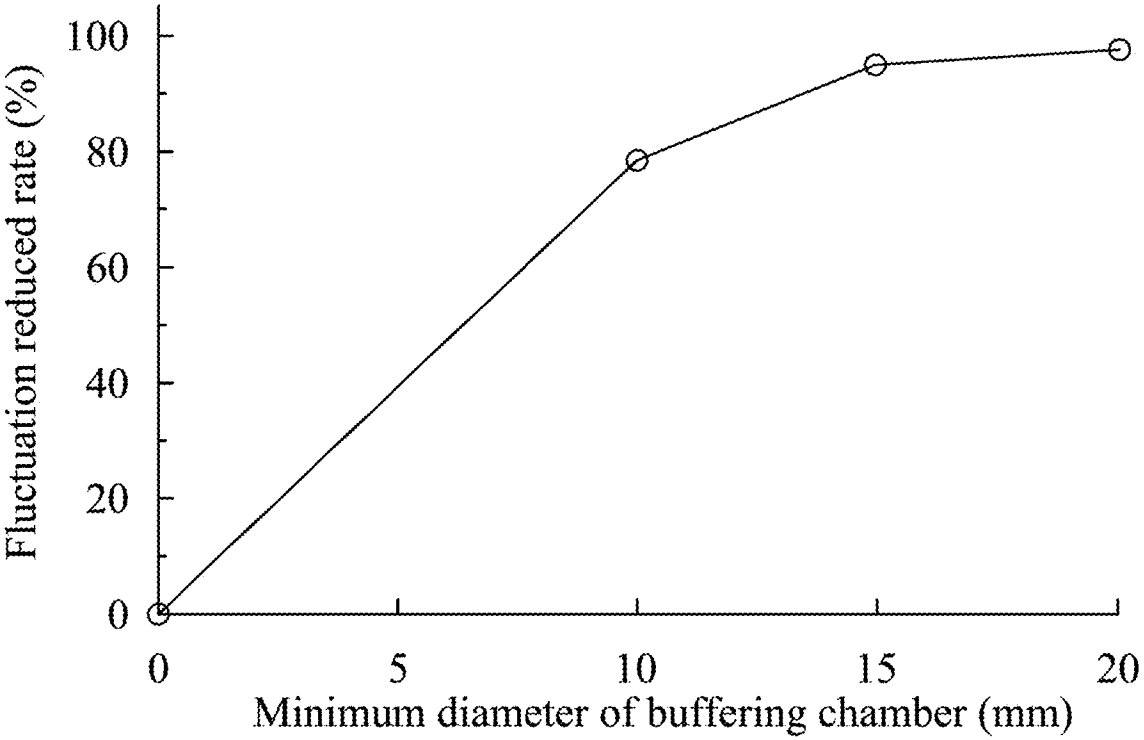
FIG. 11 shows analyzing results of the fluctuation reduced rate of the flow stabilized chip which includes the buffering chamber with different minimum diameters of the droplet generating system of the present disclosure.

Please refer to FIG. 11, which shows analyzing results of the fluctuation reduced rate of the flow stabilized chip which includes the buffering chamber with different minimum diameters of the droplet generating system of the present disclosure. As shown in FIG. 11, when the minimum diameter of the buffering chamber is 10 mm, the fluctuation reduced rate thereof can reach 92.73%, and when the minimum diameters of the buffering chamber are 15 mm and 20 mm, the fluctuation reduced rate thereof can reach 98.37% and 99.06%. According to the above, the fluctuation of the fluid rate of the fluid can be effectively reduced when the minimum diameter of the buffering chamber of the flow stabilized chip in the droplet generating system of the present disclosure ranges from 1 mm to 300 mm. Thus, the flow stabilized chip and the droplet generating system of the present disclosure have excellent turbulence stability and have application potentials in related markets.

II. Effects of the Materials of the First Elastic Membrane and the Second Elastic Membrane to the Volume Flow Rate of the Fluid In the present experiment, the effects to the volume flow rate of the fluid driven by the peristaltic pump are analyzed under the conditions that the first elastic membrane and the second elastic membrane of the buffering chamber of the flow stabilized chip in the droplet generating system of the present disclosure are made of different materials. The pure water with a flow rate being 5 μL/min to 5 mL/min is served as the aqueous phase solution, and the droplet generating systems of Example 1 and Example 2 are used in the test. In Example 1, the first elastic membrane and the second elastic membrane are made of latex, and in Example 2, the first elastic membrane and the second elastic membrane are made of nitrile butadiene rubber. Further, the minimum diameter the buffering chamber in both Example 1 and Example 2 is 1 mm for the following analysis.

Figure 12:
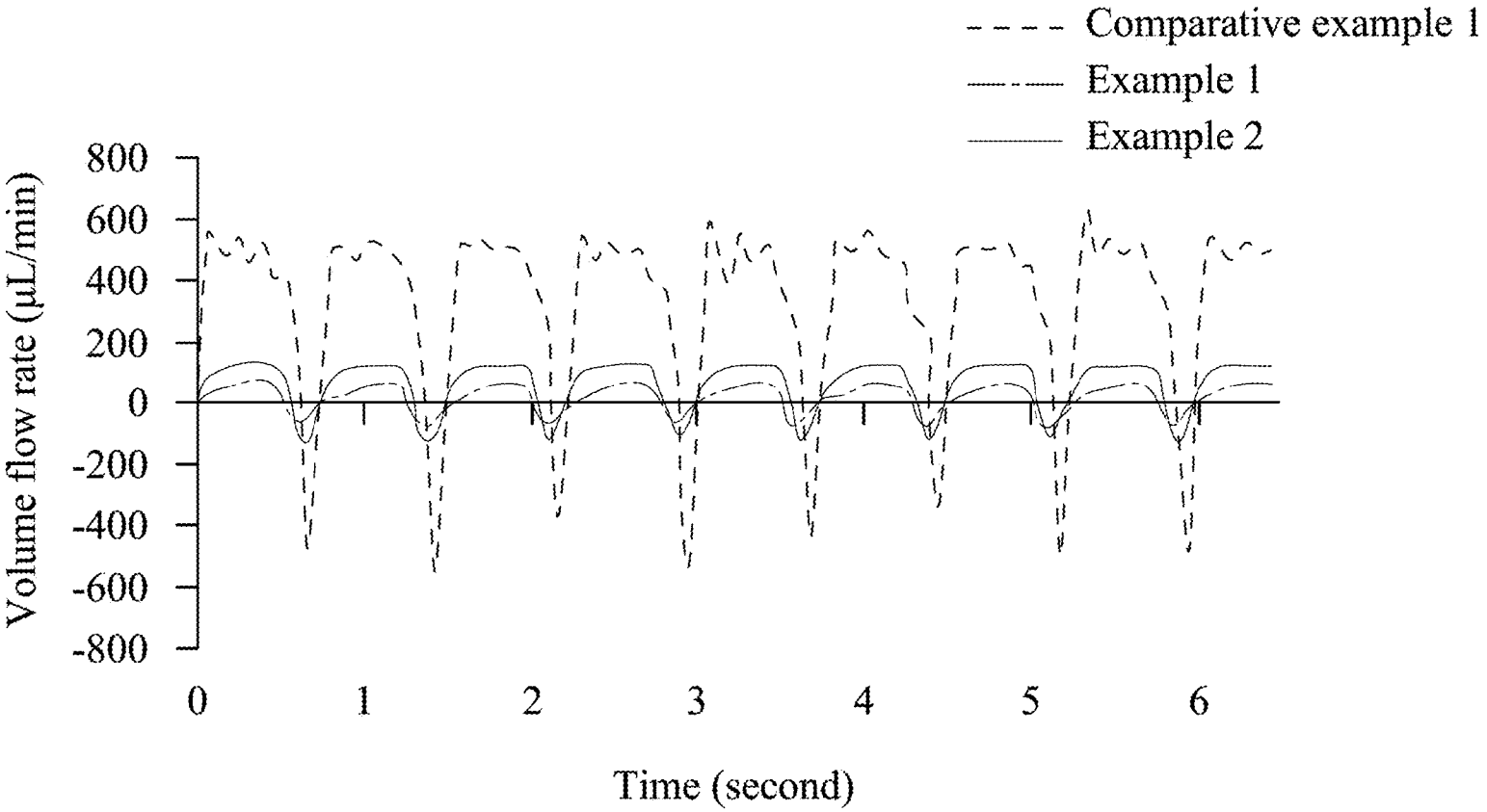
FIG. 12 shows a changing chart of volume flow rate of the flow stabilized chip in the droplet generating system of the present disclosure, wherein the flow stabilized chip includes a first elastic membrane and a second elastic membrane made of different materials.

Please refer to FIG. 12 and Table 1. FIG. 12 shows a changing chart of volume flow rate of the flow stabilized chip in the droplet generating system of the present disclosure, wherein the flow stabilized chip includes the first elastic membrane and the second elastic membrane made of different materials. Table 1 shows the values of Young's modulus of the first elastic membrane and the second elastic membrane of Example 1 and Example 2, thicknesses thereof, and the fluctuation reduced rates of Example 1 and Example 2. The fluctuation reduced rates of Example 1 and Example 2 are calculated based on the aforementioned fluctuation reduced rate formula (I), so that the details thereof are shown in the foregoing description and not described again. Furthermore, in the present experiment, Comparative example 1 is included. In Comparative example 1, the pure water is driven by a peristaltic pump alone, and the fluctuation of the flow rate thereof is measured so as to further illustrate the reducing effectivity of the fluctuation of the flow of the droplet generating system of the present disclosure.

TABLE 1

| | Example 1 | Example 2 |
|---|---|---|
| Young's modulus (MPa) | 1.82 | 5.61 |
| Thickness of membrane (mm) | 0.121 | 0.146 |
| Fluctuation reduced rate (%) | 92.73 | 75.67 |

As shown in Table 1, under the premise that the first elastic membrane and the second elastic membrane of the flow stabilized chip are made of latex, the fluctuation reduced rate of Example 1 can reach 92.73%, and under the first elastic membrane and the second elastic membrane of the flow stabilized chip are made of nitrile butadiene rubber, the fluctuation reduced rate of Example 2 also can reach 75.67%. Furthermore, as shown in FIG. 12, the changes of volume flow rate of both Example 1 and Example 2 are significantly smaller than that of Comparative example 1. According to the above, the fluctuation of the fluid rate of the fluid with a flow rate being 5 μL/min to 5 mL/min can be effectively reduced when the first elastic membrane and the second elastic membrane of the flow stabilized chip are made of latex or nitrile butadiene rubber. Thus, the droplet generating system of the present disclosure has application potentials in related markets.

III. Effects of the Shapes of the Buffering Chamber of the Flow Stabilized Chip as Well as the Materials of the First Elastic Membrane and the Second Elastic Membrane to the Fluctuation of the Flow Rate of the Fluid In the present experiment, the effects to the fluctuation of the flow rate of the fluid driven by the peristaltic pump are analyzed under the conditions that the buffering chamber of the flow stabilized chip has different shapes, and the first elastic membrane and the second elastic membrane are made of different materials in the droplet generating system of the present disclosure. The pure water with a flow rate being 5 μL/min to 5 mL/min is served as the aqueous phase solution, and the droplet generating systems of Example 3 to Example 6 are used in the test. The shapes and the minimum diameters of the buffering chambers of Example 3 to Example 6 and the materials of first elastic membrane and the second elastic membrane thereof are shown in Table 2. Furthermore, the fluctuation reduced rates of Example 3 to Example 6 are calculated based on the aforementioned fluctuation reduced rate formula (I), so that the details thereof are shown in the foregoing description and not described again.

TABLE 2

| | Shape of buffering chamber | Minimum diameter of buffering chamber (mm) | Material of membrane |
|---|---|---|---|
| Example 3 | ellipse | 1 × 2 (minor axis and major axis) | latex |
| Example 4 | circle | 1 | latex |
| Example 5 | ellipse | 1 × 2 (minor axis and major axis) | nitrile butadiene rubber |
| Example 6 | circle | 1 | nitrile butadiene rubber |

Figure 13:
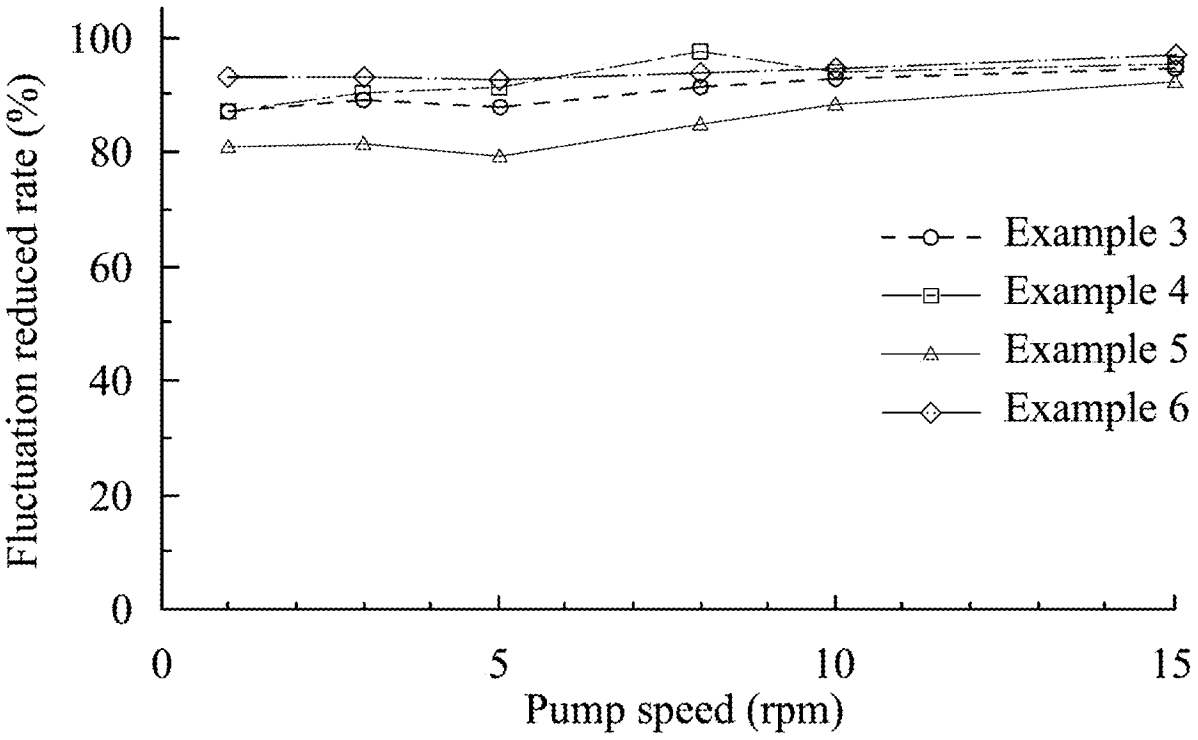
FIG. 13 shows analyzing results of the fluctuation reduced rate of the droplet generating system of the present disclosure, wherein the buffering chamber thereof has different shapes and includes a first elastic membrane and a second elastic membrane made of different materials.

Please refer to FIG. 13, which shows analyzing results of the fluctuation reduced rate of the droplet generating system of the present disclosure, wherein the buffering chamber thereof has different shapes and includes the first elastic membrane and the second elastic membrane made of different materials. As shown in FIG. 13, when the pump speed of the peristaltic pump is larger than 10 rpm, the fluctuation reduced rates of all Example 3 to Example 6 can reach 80%, and when the pump speed of the peristaltic pump is 15 rpm, the fluctuation reduced rates of all Example 3 to Example 6 are larger than 90%. According to the above, the fluctuation of the fluid rate of the fluid can be effectively reduced when the shape of the buffering chamber of the flow stabilized chip is a circle or an ellipse as well as the first elastic membrane and the second elastic membrane thereof are made of latex or nitrile butadiene rubber. Thus, the droplet generating system of the present disclosure has application potentials in related markets.

IV. Effects of the Arrangement of Compressed Tubule to the Fluctuation of the Flow Rate of the Fluid The present experiment is performed to analyze whether the fluctuation of the flow rate of the fluid driven by the peristaltic pump can be further reduced or not when the compressed tubule is disposed between the flow stabilized chip and the droplet generating chip of the droplet generating system of the present disclosure. The pure water with a flow rate being 5 μL/min to 5 mL/min is served as the aqueous phase solution, and the droplet generating systems of the aforementioned Example 3 to Example 6 are used in the test. In each of Example 3 to Example 6, the communicating tube disposed between the flow stabilized chip and the droplet generating chip includes a compressed tubule made of poly-ether-ether-ketone, and the compressed tubule is with a diameter ranges from 0.25 mm to 0.75 mm so as to observe the reduction of the fluctuation of the flow rate. Furthermore, the fluctuation reduced rates in the present experiment are calculated based on the aforementioned fluctuation reduced rate formula (I), so that the details thereof are shown in the foregoing description and not described again.

Figures 14A, 14B:
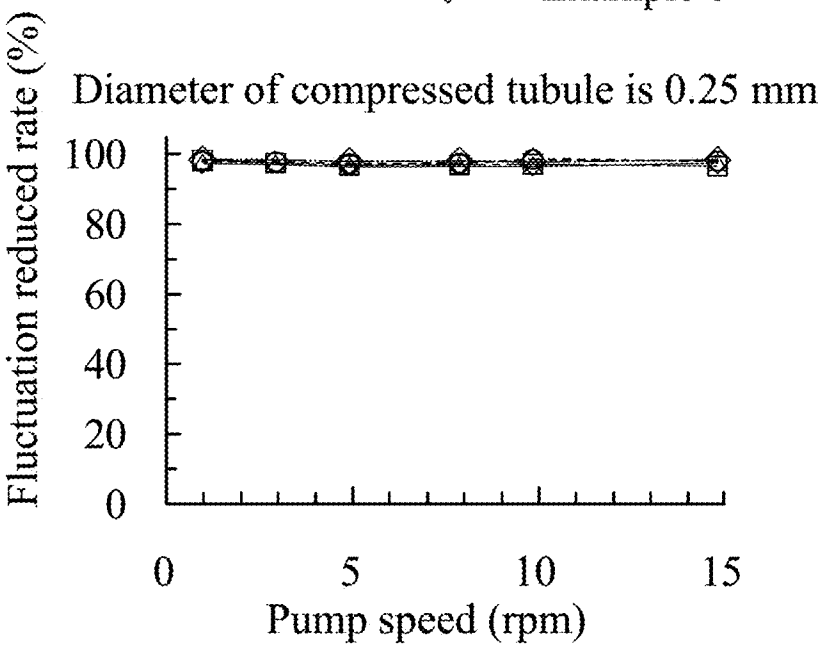
FIG. 14A shows analyzing results of the fluctuation reduced rate of the droplet generating system of the present disclosure which includes a compressed tubule with a diameter being 0.75 mm.
FIG. 14B shows analyzing results of the fluctuation reduced rate of the droplet generating system of the present disclosure which includes a compressed tubule with a diameter being 0.25 mm.

Please refer to FIG. 14A and FIG. 14B, wherein FIG. 14A shows analyzing results of the fluctuation reduced rate of the droplet generating system of the present disclosure which includes a compressed tubule with a diameter being 0.75 mm, and FIG. 14B shows analyzing results of the fluctuation reduced rate of the droplet generating system of the present disclosure which includes a compressed tubule with a diameter being 0.25 mm. As shown in FIG. 14A and FIG. 14B, when the diameter of the compressed tubule made of poly-ether-ether-ketone ranges from 0.75 mm to 0.25 mm, the fluctuation reduced rates of all the droplet generating systems of Example 3 to Example 6 are larger than 80%, and when the diameter of the compressed tubule made of poly-ether-ether-ketone is 0.25, the fluctuation reduced rates thereof are larger than 95% regardless the pump speed of the peristaltic pump. According to the above, the fluctuation of the fluid rate of the fluid can be effectively reduced when the compressed tubule is disposed between the flow stabilized chip and the droplet generating chip. Thus, the droplet generating system of the present disclosure has application potentials in related markets.

V. Stability Efficiency of the Fluctuation of the Fluid Rate of the Fluid with Different Flow Rates of the Droplet Generating System of the Present Disclosure In the present experiment, the stability efficiency of the fluctuation rate of the fluid of the fluid with different flow rates of the droplet generating system of the present disclosure is analyzed. The soybean oil with a mass concentration being 5% w/v is served as the oil phase solution, and the droplet generating systems of Example 7 to Example 12 are used in the test. The droplet generating system of Example 7 is driven by the peristaltic pump with a pump speed being 3 rpm, the droplet generating system of Example 8 is driven by the peristaltic pump with a pump speed being 5 rpm, the droplet generating system of Example 9 is driven by the peristaltic pump with a pump speed being 8 rpm, the droplet generating system of Example 10 is driven by the peristaltic pump with a pump speed being 10 rpm, the droplet generating system of Example 11 is driven by the peristaltic pump with a pump speed being 20 rpm, and the droplet generating system of Example 12 is driven by the peristaltic pump with a pump speed being 30 rpm. Furthermore, in the flow stabilized chips of Example 7 to Example 12, the first elastic membrane and the second elastic membrane are made of nitrile butadiene rubber, and the shape of the buffering chamber is an ellipse and the buffering chamber has a minimum diameter being 1 mm×2 mm (minor axis and major axis). Moreover, in the present experiment, Comparative example 2 to Comparative example 7 without flow-stable processing are included, wherein the pump speeds of peristaltic pumps of Comparative example 2 to Comparative example 7 are respectively the same as that of Example 7 to Example 12 so as to observe the stability efficiency of the fluctuation of the fluid in the droplet generating system of the present disclosure.

Figure 15B:
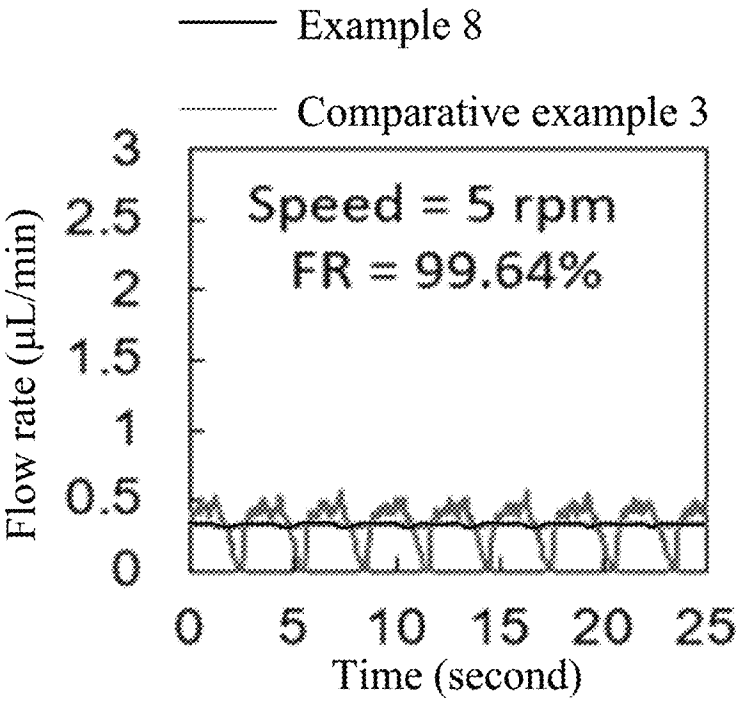
FIG. 15B shows analyzing results of the fluctuation reduced rate of the droplet generating system of Example 8 and the Comparative example 3.
Figure 15A:
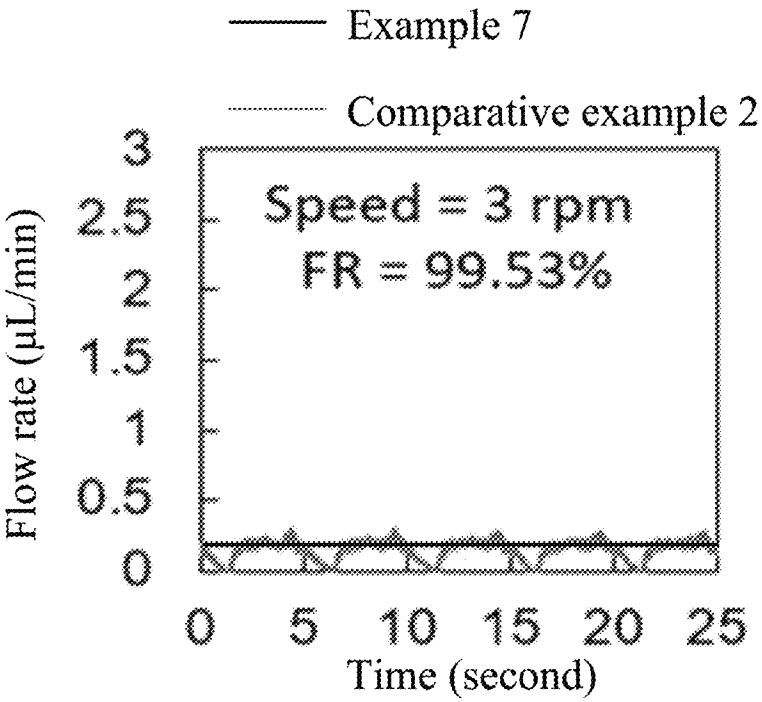
FIG. 15A shows analyzing results of the fluctuation reduced rate of the droplet generating system of Example 7 and the Comparative example 2.
Figure 15C:
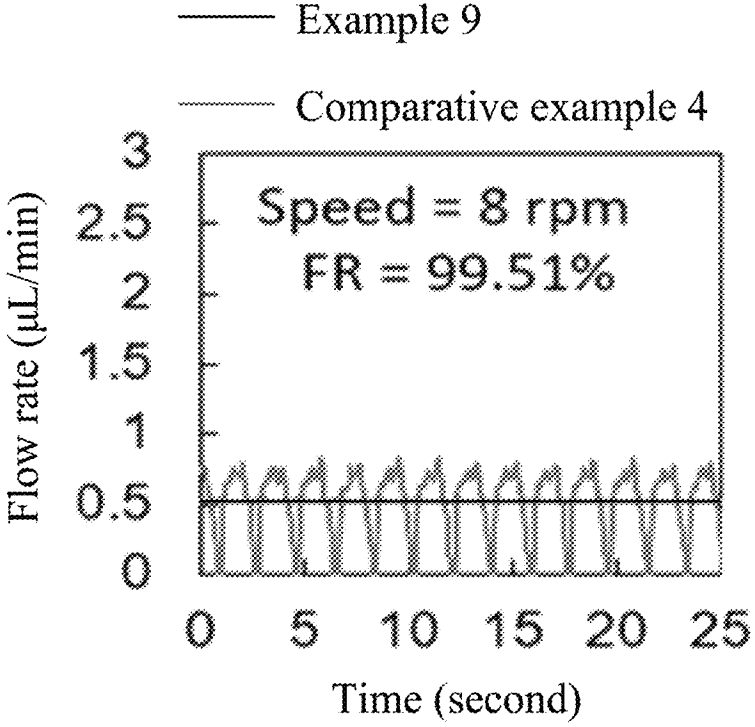
FIG. 15C shows analyzing results of the fluctuation reduced rate of the droplet generating system of Example 9 and the Comparative example 4.
Figure 15D:
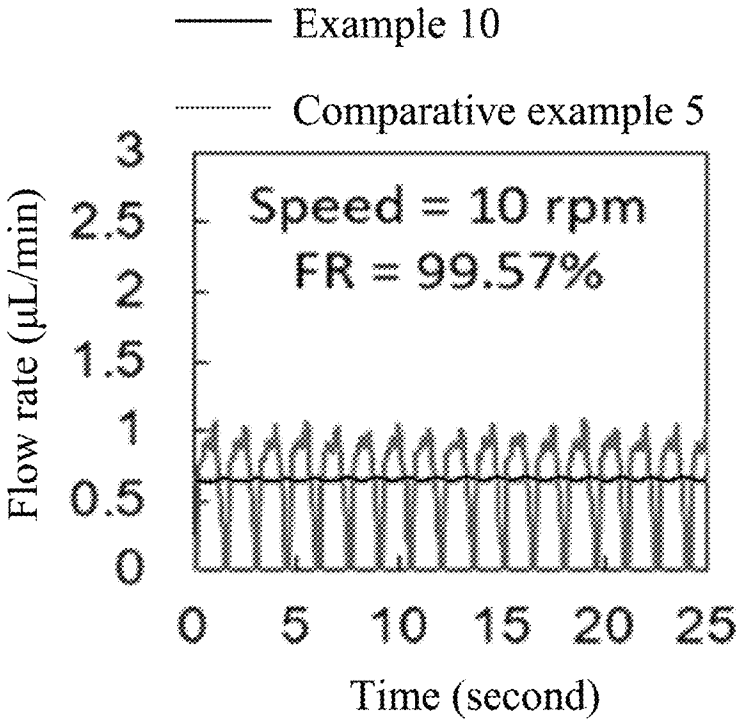
FIG. 15D shows analyzing results of the fluctuation reduced rate of the droplet generating system of Example 10 and the Comparative example 5.
Figure 15E:
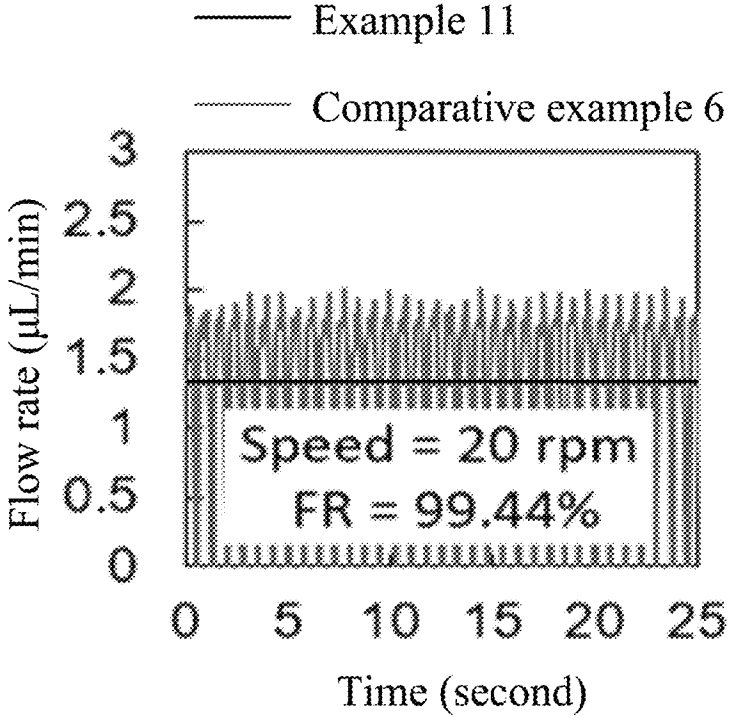
FIG. 15E shows analyzing results of the fluctuation reduced rate of the droplet generating system of Example 11 and the Comparative example 6.
Figure 15F:
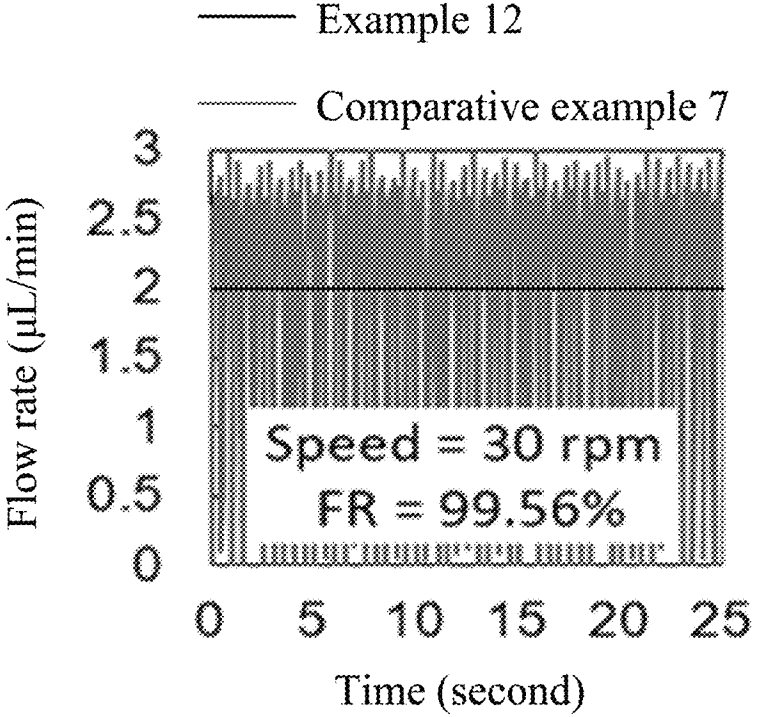
FIG. 15F shows analyzing results of the fluctuation reduced rate of the droplet generating system of Example 12 and the Comparative example 7.

Please refer to FIGS. 15A to 15F, wherein FIG. 15A shows analyzing results of the fluctuation reduced rate of the droplet generating system of Example 7 and the Comparative example 2, FIG. 15B shows analyzing results of the fluctuation reduced rate of the droplet generating system of Example 8 and the Comparative example 3, FIG. 15C shows analyzing results of the fluctuation reduced rate of the droplet generating system of Example 9 and the Comparative example 4, FIG. 15D shows analyzing results of the fluctuation reduced rate of the droplet generating system of Example 10 and the Comparative example 5, FIG. 15E shows analyzing results of the fluctuation reduced rate of the droplet generating system of Example 11 and the Comparative example 6 and FIG. 15F shows analyzing results of the fluctuation reduced rate of the droplet generating system of Example 12 and the Comparative example 7. As shown in FIGS. 15A to 15F, when the pump speed of the peristaltic pump is larger, the amplitudes of the fluctuation of the fluid of Comparative example 2 to Comparative example 7 increase correspondingly.

However, after the flow-stable process performed by the droplet generating system of the present disclosure, the fluctuation of the flow rates of the oil phase solutions of Example 7 to Example 12 can be effectively stabilized. According to the above, the fluids with different fluctuations of the flow rate can be effectively stabilized, so that the droplet generating system of the present disclosure has application potentials in related markets.

VI. Stability Efficiency of the Fluctuation of the Fluid Driven by Different Pump Speeds of the Droplet Generating System of the Present Disclosure In the present experiment, the effects to the fluctuation of the flow rate of the fluid driven by the peristaltic pump with different pump speeds are analyzed under the condition that the buffering chamber of the flow stabilized chip of the droplet generating system of the present disclosure is with different minimum diameters. The droplet generating system of Example 13 is used to test the reduction of fluctuation of the fluid rates of the fluid of the pure water and the 5% w/v soybean oil, wherein both the first elastic membrane and the second elastic membrane of the flow stabilized chip of Example 13 are made of nitrile butadiene rubber, and the shape of the buffering chamber is an ellipse and the buffering chamber has a minimum diameter being 1 mm×2 mm (minor axis and major axis).

Figure 16B:
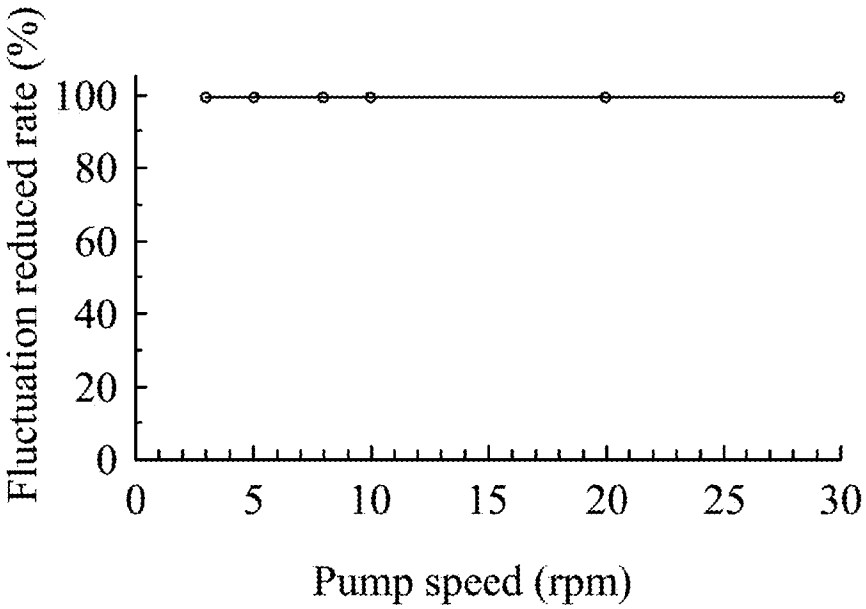
FIG. 16B shows analyzing results of the fluctuation reduced rate of the droplet generating system of the present disclosure under different pump speeds of the oil phase solution.
Figure 16A:
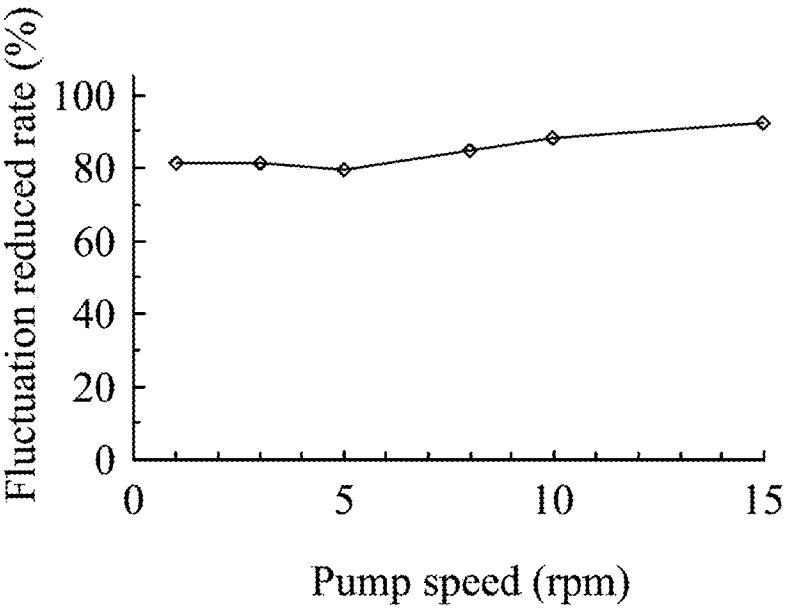
FIG. 16A shows analyzing results of the fluctuation reduced rate of the droplet generating system of the present disclosure under different pump speeds of the aqueous phase solution.

Please refer to FIG. 16A and FIG. 16B, wherein FIG. 16A shows analyzing results of the fluctuation reduced rate of the droplet generating system of the present disclosure under different pump speeds of the aqueous phase solution, and FIG. 16B shows analyzing results of the fluctuation reduced rate of the droplet generating system of the present disclosure under different pump speeds of the oil phase solution. As shown in FIG. 16A, when the pump speed of the peristaltic pump increases, the stability efficiency of the fluctuation of the flow rate to the aqueous phase solution of the droplet generating system of Example 13 is better, and as shown in FIG. 16B, the stability efficiency of the fluctuation of the flow rate to the oil phase solution of the droplet generating system of Example 13 is larger than 99% when the peristaltic pump has different pump speeds. According to the above, the fluids with different phases and fluctuation of the flow rates can be stabilized effectively by the droplet generating system of the present disclosure, so that it has application potentials in related markets.

VII. Assessing the Characteristics of Target Droplets Prepared by the Droplet Generating System of the Present Disclosure 1. Using the Droplet Generating System of the Present Disclosure and the Conventional Syringe Pump to Prepare the Target Droplets The analysis of the characteristics of target droplets prepared by the droplet generating system of the present disclosure are performed by analyzing the target droplets prepared by the droplet generating system of Example 14. In the droplet generating system of Example 14, the oil phase solution is provided after the fluctuation of the fluid rate caused by the fluid driving member is stabilized by the flow stabilized chip of the present disclosure, and the aqueous phase solution is driven by the conventional syringe pump so as to prepare the target droplets in a water-in-oil pattern. Furthermore, in the droplet generating system of Example 14, the first elastic membrane and the second elastic membrane of the flow stabilized chip are made of nitrile butadiene rubber, and the shape of the buffering chamber is an ellipse and the buffering chamber has a minimum diameter being 1 mm×2 mm (minor axis and major axis). Moreover, the droplet generating system of Example 14 is used to prepare the target droplets according to the droplet preparing method of the present disclosure, wherein a flow rate of the oil phase solution in the droplet generating chip is 320 μL/min, and a flow rate of the aqueous phase solution driven by the syringe pump is 5 μL/min to 80 μL/min. Further, other details of the droplet preparing method of the present disclosure are shown in the foregoing description and are not described herein.

Figure 17:
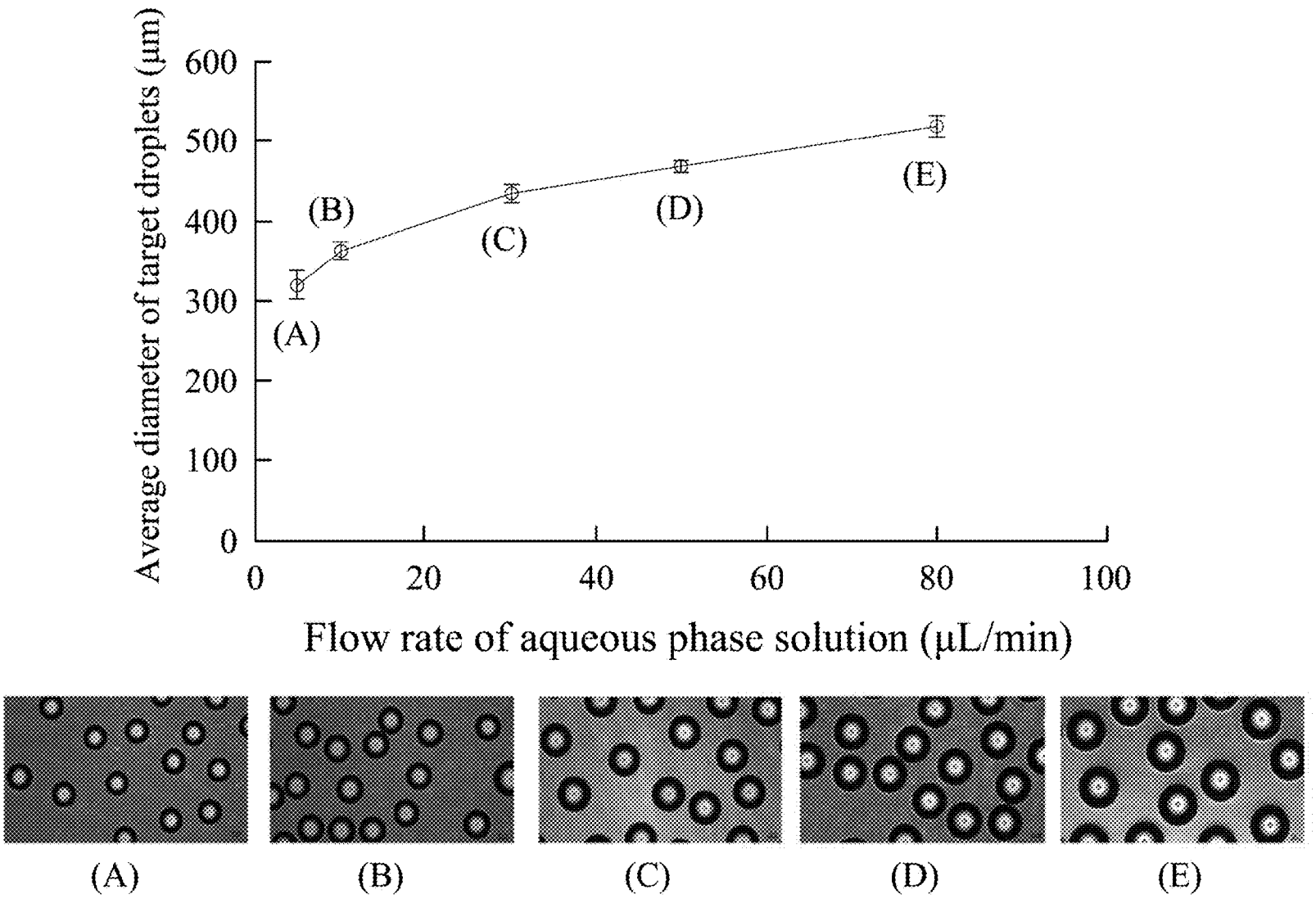
FIG. 17 shows analyzing results of the average diameter of the target droplets of the present disclosure.

Please refer to FIG. 17 and Table 3. FIG. 17 shows analyzing results of the average diameter of the target droplets of the present disclosure, wherein Mark (A) to Mark (E) of FIG. 17 respectively represent the average diameters and the images of target droplets corresponding to the aqueous phase solution with different flow rates. Table 3 shows the average diameters, the values of flow coefficient (CV) and the droplet generation frequency of the aqueous phase solution with different flow rates of Example 14.

TABLE 3

| | Flow rate of aqueous phase solution (μL/min) | Average diameter of target droplets (μm) | CV (%) | Droplet generation frequency (Hz) |
|---|---|---|---|---|
| (A) | 5 | 321 | 5.61 | 4.48 |
| (B) | 10 | 363 | 3.03 | 5.66 |
| (C) | 30 | 435 | 2.76 | 8.68 |
| (D) | 50 | 469 | 1.71 | 10.56 |
| (E) | 80 | 519 | 2.50 | 11.60 |

As shown in FIG. 17 and Table 3, the target droplets of the present disclosure are droplets with stable size and uniform phase presented in appearance, and the average diameter of the target droplets ranges from 300 μm to 500 μm. According to the above, the droplet generating system and the droplet preparing method of the present disclosure can be applied in different fields according to actual needs so as to continuously and stably prepare water-phase droplets and oil-phase droplets with stable size for a long time, so that it has application potentials in related markets.

2. Using the Droplet Generating System of the Present Disclosure to Prepare the Target Droplets The analysis of the characteristics of target droplets prepared by the droplet generating system of the present disclosure are performed by analyzing the target droplets prepared by the droplet generating system of Example 15. In the droplet generating system of Example 15, a number of the fluid storing device is two, a number of the flow stabilized chip is two, a number of the fluid driving member is two, and the droplet generating chip includes two fluid inlets so as to prepare the target droplets in a water-in-oil pattern. Furthermore, in the droplet generating system of Example 15, the first elastic membrane and the second elastic membrane of each of the flow stabilized chips are made of nitrile butadiene rubber, and the shape of the buffering chamber of each of the flow stabilized chip is an ellipse and the buffering chamber has a minimum diameter being 1 mm×2 mm (minor axis and major axis). Moreover, the droplet generating system of Example 15 is used to prepare the target droplets according to the droplet preparing method of the present disclosure, wherein the a flow rate of the oil phase solution in the droplet generating chip is 320 μL/min, and a flow rate of the aqueous phase solution in the droplet generating chip is 60 μL/min. Further, other details of the droplet preparing method of the present disclosure are shown in the foregoing description and are not described herein.

Figure 18:
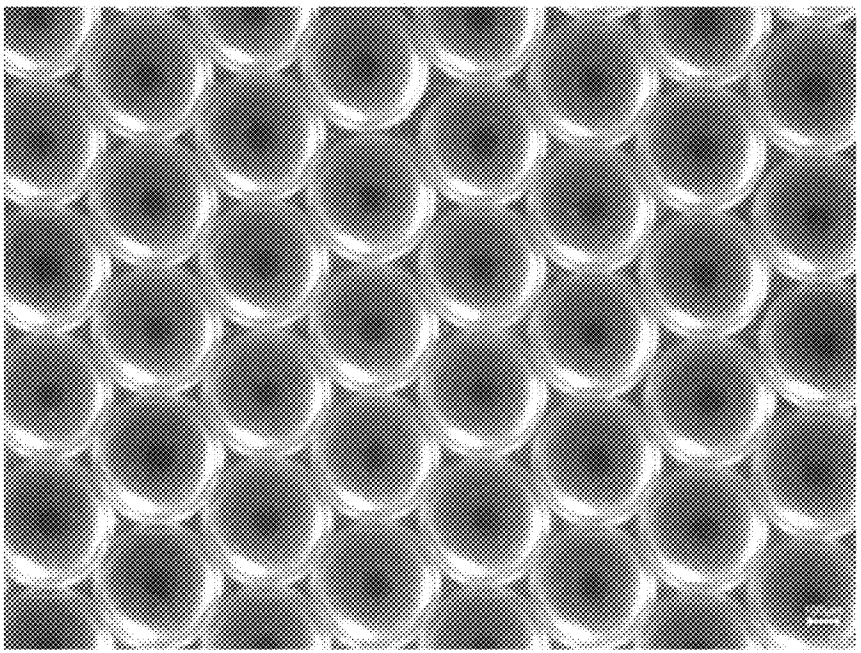
FIG. 18 shows an image of the target droplets of the present disclosure.

Please refer to FIG. 18, which shows an image of the target droplets of the present disclosure. As shown in FIG. 18, the target droplets of the present disclosure are droplets with stable size and uniform phase presented in appearance, wherein the average diameter of the target droplets is 443 μm, the flow coefficient is 1.98%, the droplet generation frequency is 15.00 Hz, and the target droplets can be continuously prepared for more than 24 hours. According to the above, the droplet generating system and the droplet preparing method of the present disclosure can be applied in different fields according to actual needs so as to continuously and stably prepare water-phase droplets and oil-phase droplets, and oil-in-water droplets or water-in-oil droplets with stable size and uniform phase can be prepared. Thus, it is favorable for conducting the preparation of chemical materials, two-phase extraction of liquids, or cell culture, and has application potentials in related markets.

To sum up, by the arrangement that the first elastic membrane, the second base plate and the second elastic membrane are stacked in sequence to form the buffering chamber, the flow stabilized chip of the present disclosure can buffer the liquid automatically when the liquid is transported to the buffering chamber 120, so that the stability of the flows output by the flow stabilized chip of the present disclosure can be enhanced significantly. Furthermore, by the connection of the flow stabilized chip, the droplet generating chip and the fluid driving member of the droplet generating system and the droplet preparing method of the present disclosure, the fluctuation of the flow rate of the fluid will be stabilized first while passing through the flow stabilized chip, and the droplets with stable size can be prepared continuously by the droplet generating chip. Thus, it has application potentials in related markets.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A flow stabilized chip, comprising:

a chip mainbody having a pipe-connection surface;

a buffering chamber disposed in the chip mainbody; and two fluid delivery ports disposed on the pipe connection surface and connected to the buffering chamber;

wherein the chip mainbody comprises, in order from the pipe-connection surface to a bottom of the chip mainbody:

a first base plate comprising a first opening, wherein the first opening is opened on the pipe-connection surface of the chip mainbody;

a first elastic membrane;

a second base plate comprising a second opening;

a second elastic membrane; and a third base plate comprising a third opening;

wherein the first elastic membrane, the second base plate and the second elastic membrane are stacked in sequence to form the buffering chamber, and the first elastic membrane and the second elastic membrane are respectively exposed to an external space of the flow stabilized chip through the first opening and the third opening.

2. The flow stabilized chip of claim 1, wherein the chip mainbody further comprises four plastic sheets, the four plastic sheet are respectively disposed between the first base plate and the first elastic membrane, between the first elastic membrane and the second base plate, between the second base plate and the second elastic membrane, and between the second elastic membrane and the third base plate.

3. The flow stabilized chip of claim 1, wherein the first elastic membrane is made of latex or nitrile butadiene rubber, and the second elastic membrane is made of latex or nitrile butadiene rubber.

4. The flow stabilized chip of claim 1, wherein a diameter of the buffering chamber ranges from 1 mm to 300 mm.

* * * * *